US008322807B2

(12) United States Patent
Seki et al.

(10) Patent No.: US 8,322,807 B2
(45) Date of Patent: Dec. 4, 2012

(54) INK JET PRINTING APPARATUS AND INK JET PRINTING METHOD WITH STIR MODE FOR STIR OPERATION OF INK TANK

(75) Inventors: Satoshi Seki, Kawasaki (JP); Hitoshi Nishikori, Tokyo (JP); Daisaku Ide, Tokyo (JP); Yoshito Mizoguchi, Kawasaki (JP); Yasuo Kotaki, Yokohama (JP); Tetsuya Ohashi, Matsudo (JP); Ryoji Inoue, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 399 days.

(21) Appl. No.: 11/808,434

(22) Filed: Jun. 11, 2007

(65) Prior Publication Data

US 2007/0291077 A1 Dec. 20, 2007

(30) Foreign Application Priority Data

Jun. 16, 2006 (JP) ..... 2006-168007

(51) Int. Cl.
*B41J 29/38* (2006.01)
*B41J 23/00* (2006.01)

(52) U.S. Cl. ..... 347/6; 347/14; 347/37

(58) Field of Classification Search ..... 347/6
See application file for complete search history.

(56) References Cited

U.S. PATENT DOCUMENTS 5,663,750 A * 9/1997 Sakuma ..... 347/7
6,951,382 B2 * 10/2005 Inui et al. ..... 347/37
2001/0055041 A1 * 12/2001 Yonekubo ..... 347/19
2003/0179257 A1 * 9/2003 Inui et al. ..... 347/19
2007/0263025 A1 * 11/2007 Ohashi et al. ..... 347/19
2007/0263048 A1 11/2007 Okito et al. ..... 347/85
2007/0263052 A1 11/2007 Iijima et al. ..... 347/92
2007/0291076 A1 12/2007 Seki et al. ..... 347/37
2009/0079802 A1 * 3/2009 Ito ..... 347/85

FOREIGN PATENT DOCUMENTS

EP 1138500 10/2001
EP 1145857 10/2001
EP 1279511 1/2003
EP 1283110 2/2003
EP 1757453 2/2007

(Continued)

OTHER PUBLICATIONS

English translation of Japanese patent document 2003-311993 A, "Ink Jet-Style Recording Device" to Ishimoto et al.; translated by Schreiber Translation, Inc., Oct. 2009; 71 pp.*

(Continued)

*Primary Examiner* — Shelby Fidler
(74) *Attorney, Agent, or Firm* — Fitzpatrick, Cella, Harper & Scinto

(57) ABSTRACT

The present invention provides an ink jet printing apparatus and a method for controlling an ink jet printing apparatus which, during a non-print operation excluding a print operation, can stir ink at a required time and to a required level according to the state of the ink in the ink tank. During a non-print operation excluding a print operation accompanied by a reciprocal movement of the carriage, a stir operation is executed to stir the ink in the ink tank by reciprocating the carriage according to a stir mode. As the stir mode, one of different modes is set according to an elapsed time from the previous stir operation.

10 Claims, 29 Drawing Sheets

FOREIGN PATENT DOCUMENTS

| | | | | |
|---|---|---|---|---|
| JP | 4-169240 | | | 6/1992 |
| JP | 4-87250 | | | 7/1992 |
| JP | 5-338195 | | | 12/1993 |
| JP | 07205592 | A | * | 8/1995 |
| JP | 9-309212 | | | 12/1997 |
| JP | 2002-316426 | | | 10/2002 |
| JP | 2003311993 | A | * | 11/2003 |
| JP | 2004-1411 | | | 1/2004 |
| JP | 2004-167701 | | | 6/2004 |

OTHER PUBLICATIONS

European Office Search Report from corresponding European Application No. 07011405.3, dated Oct. 11, 2007.

Japanese Office Action from corresponding Japanese Application No. 2006-168007, dated Apr. 15, 2008, and English language translation thereof.

* cited by examiner

| ELAPSED TIME | MODE | IDLE SCAN |
|---|---|---|
| $0 < T \leqq S1$ | STIR MODE A | 20 RECIPROCAL MOVEMENTS |
| $S1 < T \leqq S2$ | STIR MODE B | 50 RECIPROCAL MOVEMENTS |
| $S2 < T$ | STIR MODE C | 120 RECIPROCAL MOVEMENTS |

FIG.26

| USED INK AMOUNT | MODE | IDLE SCAN |
|---|---|---|
| $0 < D \leqq S3$ | STIR MODE X | 0 RECIPROCAL MOVEMENTS |
| $S3 < D \leqq S4$ | STIR MODE Y | 30 RECIPROCAL MOVEMENTS |
| $S4 < D$ | STIR MODE Z | 60 RECIPROCAL MOVEMENTS |

FIG.27

| D \ T | 0h ≦ T < 24h | 24h ≦ T < 120h | 120h ≦ T < 240h | 240h ≦ T < 480h | 480h ≦ T < 720h | 720h ≦ T < 2160h | 2160h ≦ T |
|---|---|---|---|---|---|---|---|
| 0 < D ≦ 7g | STIR MODE A | STIR MODE A | STIR MODE A | STIR MODE B | STIR MODE B | STIR MODE B | STIR MODE C |
| 7g < D ≦ 10g | STIR MODE A | STIR MODE A | STIR MODE B | STIR MODE B | STIR MODE B | STIR MODE C | STIR MODE C |
| 10g < D | STIR MODE A | STIR MODE B | STIR MODE B | STIR MODE B | STIR MODE C | STIR MODE C | STIR MODE C |

FIG.28

INK JET PRINTING APPARATUS AND INK JET PRINTING METHOD WITH STIR MODE FOR STIR OPERATION OF INK TANK

BACKGROUND OF THE INVENTION

1. Field of the Invention

The present invention relates to an ink jet printing apparatus which print an image by moving a carriage that can mount a print head and an ink tank and a method for controlling the ink jet printing apparatus.

2. Description of the Related Art

A pigment ink has higher weatherability than a dye ink and is therefore beginning to be used on ink jet printing apparatus in recent years. The weatherability includes lightfastness, ozone resistance and waterfastness. Pigment particles contained in the pigment ink do not easily lose their color saturation if decomposed by light or ozone and their colors do not fade if exposed to light or ozone for a long period of time. Thus, the pigment ink shows its particularly excellent performance when used for the printing of outdoor advertisements and exhibits that are displayed for long periods or of pictures that need to be stored for long period. Further, since pigment particles are not water-soluble, the pigment ink has better waterfastness than dye ink. Because of these advantages, the oil-based pigment inks are widely used.

Generally, ink jet printing apparatus often use water-based ink. To make water-soluble those color materials not soluble in water, such as pigments, requires rendering the pigment particles hydrophilic by using polymer resins or surfactants and dispersing them in water or other solvent components.

If a pigment is used as an ink colorant and accommodated in an ink tank or other container and left unused, the pigment will deposit at the bottom of the ink tank, changing an ink concentration which will unavoidably become ununiform. Solid particles such as pigment are suspended in a liquid as fine particles. If their specific gravity is greater than that of the solvent (medium), it is known from the following equation (1) that the particles will settle.

$$u=2r2(\rho_2-\rho_1)g/9\eta \quad (1)$$

Where u is a settling rate of particles, r is a radius of particles when the pigment particles are assumed to be spherical, $\rho_1$ is density of medium (solvent), $\rho_2$ is density of particles, g is a gravitational acceleration and $\eta$ is a viscosity coefficient of the medium. The equation (1) is called Navier-Stokes' equation. The equation (1) also shows that the water-based pigment ink with water as a main component of medium has a faster setting rate than that of the oil-based pigment ink. It is noted, however, that the pigment particles are subjected to a thermal motion of medium molecules in addition to the settling action by gravity and therefore are continuously in the Brownian motion. This Brownian motion causes the pigment particles to disperse, an action opposing the settling action, to realize a uniform particle distribution. This means that the pigment particles do not always settle according to the above equation (1). By improving the degree of hydrophilicity of pigment, i.e., the level of pigment diffusion in solvent, a pigment ink can be produced whose pigment particles will not easily deposit. However, the pigment particles still settle gradually in small numbers.

When the pigment particles settle, the property of the pigment ink, such as colorant concentration, viscosity and specific gravity, will change. In the ink jet printing apparatus, changes in a colorant concentration of the pigment ink lead directly to a color change in images, and changes in ink viscosity and specific gravity affect an injection volume and an injection speed of ink.

Therefore, in the ink jet printing apparatus using pigment inks, it is important to uniform the pigment ink concentration in the ink tank.

As a method for making the pigment ink concentration in an ink tank uniform, it is known to directly stir ink in the ink tank. For example, Japanese Utility Model Laid-Open No. 4-087250 (1992) describes a method in which a reciprocally movable carriage mounting a print head and an ink tank is moved before a printing operation or at specified time intervals to agitate the ink in the ink tank. Another Japanese Patent Laid-Open No. 5-338195 (1993) discloses a method which rotates or reverses an ink tank by a motor to change the direction of gravity acting in the ink tank to prevent the sedimentation of pigment particles. Further, to ensure the effectiveness of the ink stirring, Japanese Patent Laid-Open Nos. 4-169240 (1992) and 9-309212 (1997) disclose a method that uses a steel ball in the ink tank to facilitate the stirring of ink. Still another Japanese Patent Laid-Open No. 2004-001411 discloses a method which measures a time that elapses from the movement of the carriage and from the print operation involving an ink ejection from the print head and which changes the stirring operation according to the elapsed time.

If left unused for many hours, the ink in the ink jet printing apparatus has its colorant settle, causing the concentration in an upper part of the ink tank to decrease and that in a lower part to increase, with the result that the ink concentration becomes ununiform in the ink tank. If a recovery operation to maintain a good ink ejection performance of the print head is performed by discharging an ink, that does not contribute to the image printing, from a print head connected to the lower part of the ink tank, the high concentration ink is discharged from the ink tank. As a result, the colorant concentration in the ink tank gradually falls causing density variations in a printed image, which may lead to image impairments.

The stirring operation, such as described in the above-cited references, can indeed alleviate the ink concentration changes in the ink tank or ink supply paths. However, if the ink stirring operation is done prior to the print operation, a relatively long time must be spent executing the stir operation before the print operation can be started. It is therefore desired that a required amount of stirring operation be performed at distributed, appropriate timings.

The method of Japanese Patent Laid-Open No. 2004-001411 changes the kind of stirring operation according to the time which elapsed from the last print operation. In this method, if print operations of short durations are repeated intermittently, the stirring operation may not be performed at all or only small stirring operations may be performed repetitively because the elapsed time from the previous print operation to the next is short. In that case, the pigment component may settle, depending on the kind of pigment ink, giving rise to a possibility of the stirring operation failing to be performed satisfactorily.

SUMMARY OF THE INVENTION

The present invention provides an ink jet printing apparatus and a method for controlling an ink jet printing apparatus which, during a non-print operation excluding a print operation, can stir ink to a required degree at a required time according to the state of ink in the ink tank.

In the first aspect of the present invention, there is provided an ink jet printing apparatus for printing an image on a print medium by using a carriage mounting an ink tank to supply ink to an ink ejection portion and by ejecting the ink from the ink ejection portion as the carriage is reciprocally moved; the ink jet printing apparatus comprising: mode setting means for setting a stir mode for executing a stir operation of stirring the ink in the ink tank, the stir operation being executed by reciprocating the carriage during a non-print operation excluding a print operation accompanied by a reciprocal movement of the carriage; and control means for executing the stir operation according to the stir mode set by the mode setting means; wherein the mode setting means sets one of a plurality of different stir modes according to at least one of an elapsed time from a previous stir operation and a remaining ink amount in the ink tank.

In the second aspect of the present invention, there is provided an ink jet printing apparatus for printing an image on a print medium by using a carriage mounting an ink tank to supply ink to an ink ejection portion and by ejecting the ink from the ink ejection portion as the carriage is reciprocally moved; the ink jet printing apparatus comprising: mode setting means for setting a stir mode for executing a stir operation of stirring the ink in the ink tank, the stir operation being executed by reciprocating the carriage during a non-print operation excluding a print operation accompanied by a reciprocal movement of the carriage; wherein the mode setting means set the stir mode from among modes which differ in at least one of parameters, the parameters representing the number of carriage reciprocating movements, a carriage moving speed, a carriage acceleration and a distance moved by the carriage.

In the third aspect of the present invention, there is provided a method for controlling an ink jet printing apparatus for printing an image on a print medium by using a carriage mounting an ink tank to supply ink to an ink ejection portion and by ejecting the ink from the ink ejection portion as the carriage is reciprocally moved; the method comprising: a mode setting step that sets a stir mode for executing a stir operation of stirring the ink in the ink tank, the stir operation being executed by reciprocating the carriage during a non-print operation excluding a print operation accompanied by a reciprocal movement of the carriage; wherein, in the mode setting step, one of a plurality of different stir modes is set according to at least an elapsed time from a previous stir operation and a remaining ink amount in the ink tank.

With this invention, during a non-print operation excluding a print operation, the ink stirring operation can be performed to a required degree at a required time by reciprocally moving the carriage according to a stir mode based on the ink state in the ink tank. As a result, the ink in the ink tank can be made uniform in concentration, assuring a printing of images in good condition.

Further features of the present invention will become apparent from the following description of exemplary embodiments (with reference to the attached drawings).

BRIEF DESCRIPTION OF THE DRAWINGS

FIG. 24 is a diagram showing the relationship of FIGS. 24A and 24B;

FIG. 26 illustrates a stir mode selected in the first embodiment of this invention;

FIG. 27 illustrates a stir mode selected in the second embodiment of this invention; and FIG. 28 illustrates a stir mode selected in the fourth embodiment of this invention.

DESCRIPTION OF THE EMBODIMENTS

Now, referring to the accompanying drawings, the preferred embodiments of this invention will be described in detail. In this invention, the word "idle scan" means a scan operation of a print head executed without ejecting ink for printing purpose from the print head.

1. Basic Configuration 1.1 Outline of Printing System

Figure 1:
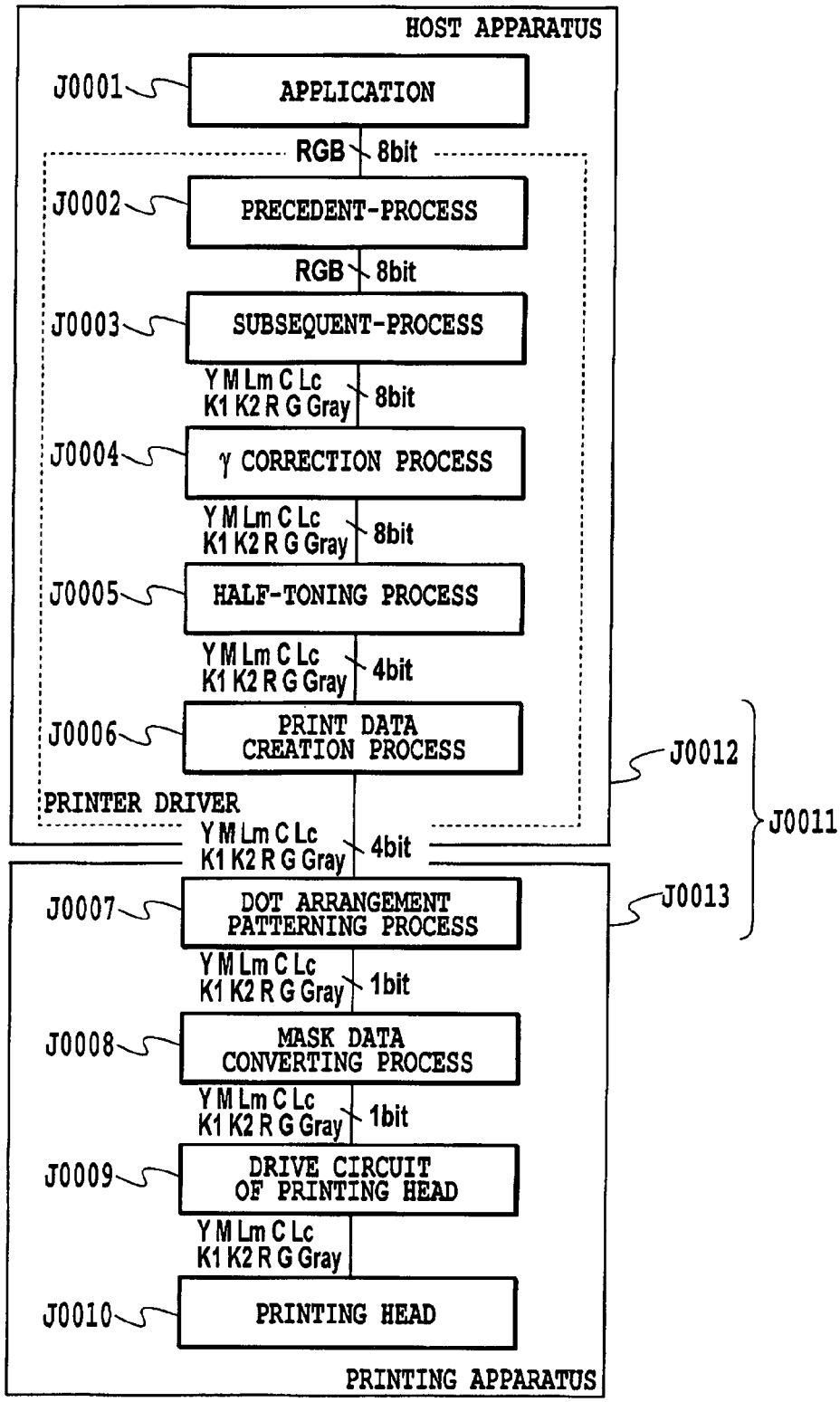
FIG. 1 is a diagram for explaining a flow in which image data are processed in a printing system to which an embodiment of the present invention is applied.

FIG. 1 is a diagram for explaining a flow in which image data are processed in a printing system to which an embodiment of the present invention is applied. This printing system J0011 includes a host apparatus J0012 which generates image data indicating an image to be printed, and which sets up a user interface (UI) for generating the data and so on. In addition, the printing system J0011 includes a printing apparatus J0013 which prints an image on a printing medium on the basis of the image data generated by the host apparatus J0012.

The printing apparatus J0013 performs a printing operation by use of 10 color inks of cyan (C), light cyan (Lc), magenta (M), light magenta (Lm), yellow (Y), red (R), green (G), black 1 (K1), black 2 (K2) and gray (Gray). To this end, a printing head H1001 for ejecting these 10 color inks is used for the printing apparatus J0013. These 10 color inks are pigmented inks respectively including ten color pigments as the color materials thereof.

Programs operated with an operating system of the host apparatus J0012 include an application and a printer driver. An application J0001 executes a process of generating image data with which the printing apparatus makes a print. Personal computers (PC) are capable of receiving these image data or pre-edited data which is yet to process by use of various media. By means of a CF card, the host apparatus according to this embodiment is capable of populating, for example, JPEG-formatted image data associated with a photo taken with a digital camera. In addition, the host apparatus according to this embodiment is capable of populating, for example, TIFF-formatted image data read with a scanner and image data stored in a CD-ROM. Moreover, the host apparatus according to this embodiment is capable of capturing data from the Web through the Internet. These captured data are displayed on a monitor of the host apparatus. Thus, an edit, a process or the like is applied to these captured data by means of the application J0001. Thereby, image data R, G and B are generated, for example, in accordance with the sRGB specification. A user sets up a type of printing medium to be used for making a print, a printing quality and the like through a UI screen displayed on the monitor of the host apparatus. The user also issues a print instruction through the UI screen. Depending on this print instruction, the image data R, G and B are transferred to the printer driver.

The printer driver includes a precedent process J0002, a subsequent process J0003, a γ correction process J0004, a half-toning process J0005 and a print data creation process J0006 as processes performed by itself. Brief descriptions will be provided below for these processes J0002 to J0006.

(A) Precedent Process

The precedent process J0002 performs mapping of a gamut. In this embodiment, data are converted for the purpose of mapping the gamut reproduced by image data R, G and B in accordance with the sRGB specification onto a gamut to be produced by the printing apparatus. Specifically, a respective one of image data R, G and B deal with 256 gradations of the respective one of colors which are represented by 8 bits. These image data R, G and B are respectively converted to 8-bit data R, G and B in the gamut of the printing apparatus J0013 by use of a three-dimensional LUT.

(B) Subsequent Process

On the basis of the 8-bit data R, G and B obtained by mapping the gamut, the subsequent process J0003 obtains 8-bit color separation data on each of the 10 colors. The 8-bit color separation data correspond to a combination of inks which are used for reproducing a color represented by the 8-bit data R, G and B. In other words, the subsequent process J0003 obtains color separation data on each of Y, M, Lm, C, Lc, K1, K2, R, G, and Gray. In this embodiment, like the precedent process, the subsequent process is carried out by using the three dimensional LUT, simultaneously using an interpolating operation.

(C) γ Correction Process

The γ correction J0004 converts the color separation data on each of the 10 colors which have been obtained by the subsequent process J0003 to a tone value (gradation value) representing the color. Specifically, a one-dimensional LUT corresponding to the gradation characteristic of each of the color inks in the printing apparatus J0013 is used, and thereby a conversion is carried so that the color separation data on the 10 colors can be linearly associated with the gradation characteristics of the printer.

(D) Half-Toning Process

The half-toning process J0005 quantizes the 8-bit color separation data on each of Y, M, Lm, C, Lc, K1, K2, R, G and Gray to which the γ correction process has been applied so as to convert the 8-bit separation data to 4-bit data. In this embodiment, the 8-bit data dealing with the 256 gradations of each of the 10 colors are converted to 4-bit data dealing with 9 gradations by use of the error diffusion method. The 4-bit data are data which serve as indices each for indicating a dot arrangement pattern in a dot arrangement patterning process in the printing apparatus.

(E) Print Data Creation Process

The last process performed by the printer driver is the print data creation process J0006. This process adds information on print control to data on an image to be printed whose contents are the 4-bit index data, and thus creates print data.

Figure 2:
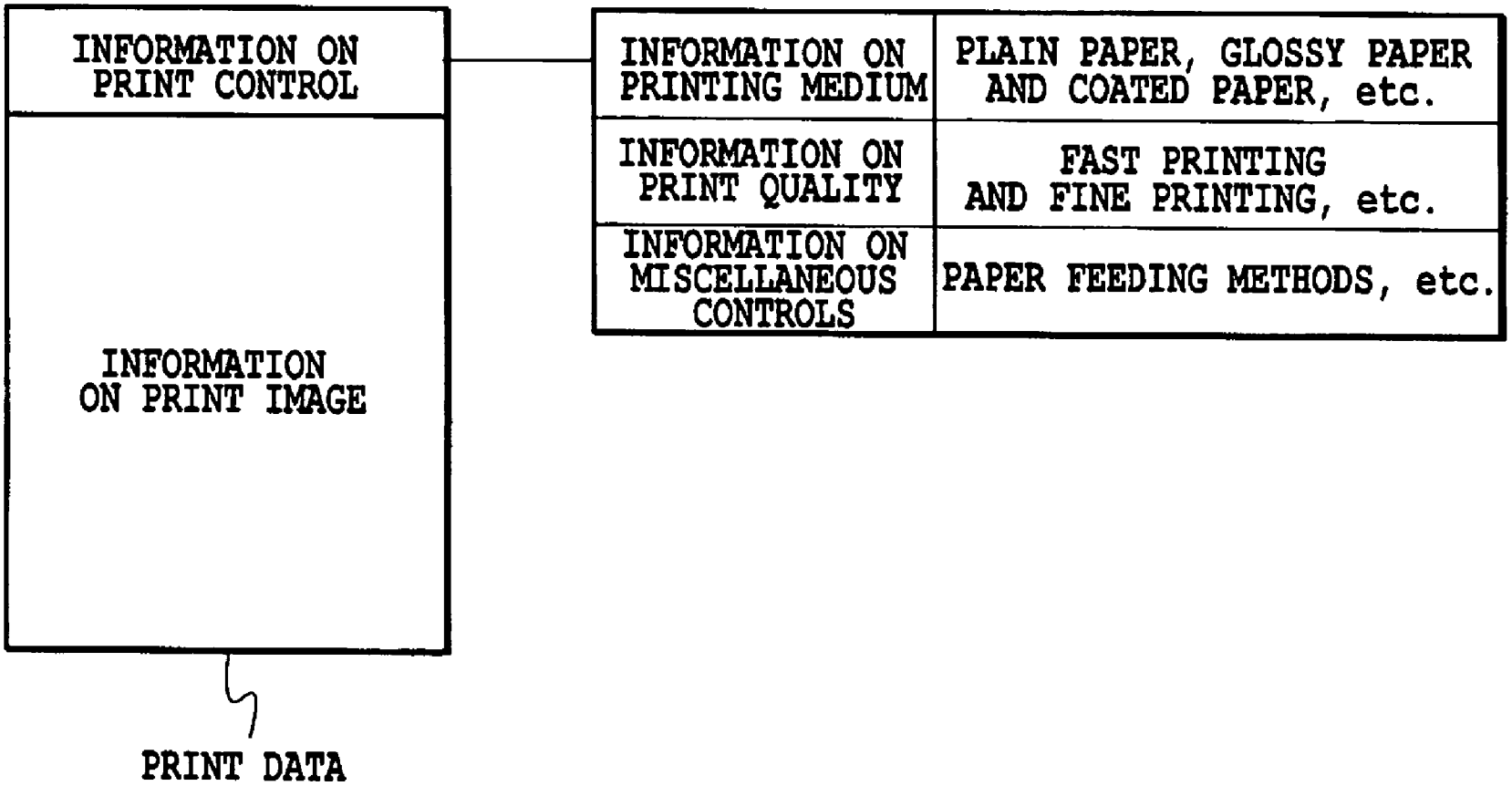
FIG. 2 is an explanatory diagram showing an example of a configuration of print data transferred from a printer driver of a host apparatus to a printing apparatus in the printing system shown in FIG. 1.

FIG. 2 is a diagram showing an example of a configuration of the print data. The print data are configured of the information on print control and the data on an image to be printed. The information on print control is in charge of controlling a printing operation. The data on an image to be printed indicates an image to be printed (the data are the foregoing 4-bit index data). The information on print control is configured of "information on printing media," "information on print qualities," and "information on miscellaneous controls" including information on paper feeding methods or the like. Types of printing media on which to make a print are described in the information on printing media. One type of printing medium selected out of a group of plain paper, glossy paper, a post card, a printable disc and the like is specified in the information on printing media. Print qualities to be sought are described in the information on print qualities. One type of print quality selected out of a group of "fine (high-quality print)," "normal," "fast (high-speed print)" and the like is specified in the information on print qualities. Note that these pieces of information on print control are formed on the basis of contents which a user designates through the UI screen in the monitor of the host apparatus J0012. In addition, image data originated in the half-toning process J0005 are described in the data on an image to be printed. The print data thus generated are supplied to the printing apparatus J0013.

The printing apparatus J0013 performs a dot arrangement patterning process J0007 and a mask data converting process J0008 on the print data which have been supplied from the host apparatus J0012. Descriptions will be provided next for the dot arrangement patterning process J0007 and the mask data converting process J0008.

(F) Dot Arrangement Patterning Process

In the above-described half-toning process J0005, the number of gradation levels is reduced from the 256 tone values dealt with by multi-valued tone information (8-bit data) to the 9 tone values dealt with by information (4-bit data). However, data with which the printing apparatus J0013 is actually capable of making a print are binary data (1-bit) data on whether or not an ink dot should be printed. Taken this into consideration, the dot arrangement patterning process J0007 assigns a dot arrangement pattern to each pixel represented by 4-bit data dealing with gradation levels 0 to 8 which are an outputted value from the half-toning process J0005. The dot arrangement pattern corresponds to the tone value (one of the levels 0 to 8) of the pixel. Thereby, whether or not an ink dot should be printed (whether a dot should be on or off) is defined for each of a plurality of areas in each pixel. Thus, 1-bit binary data indicating "1 (one)" or "0 (zero)" are assigned to each of the areas of the pixel. In this respect, "1 (one)" is binary data indicating that a dot should be printed. "0 (zero)" is binary data indicating that a dot should not be printed.

Figure 3:
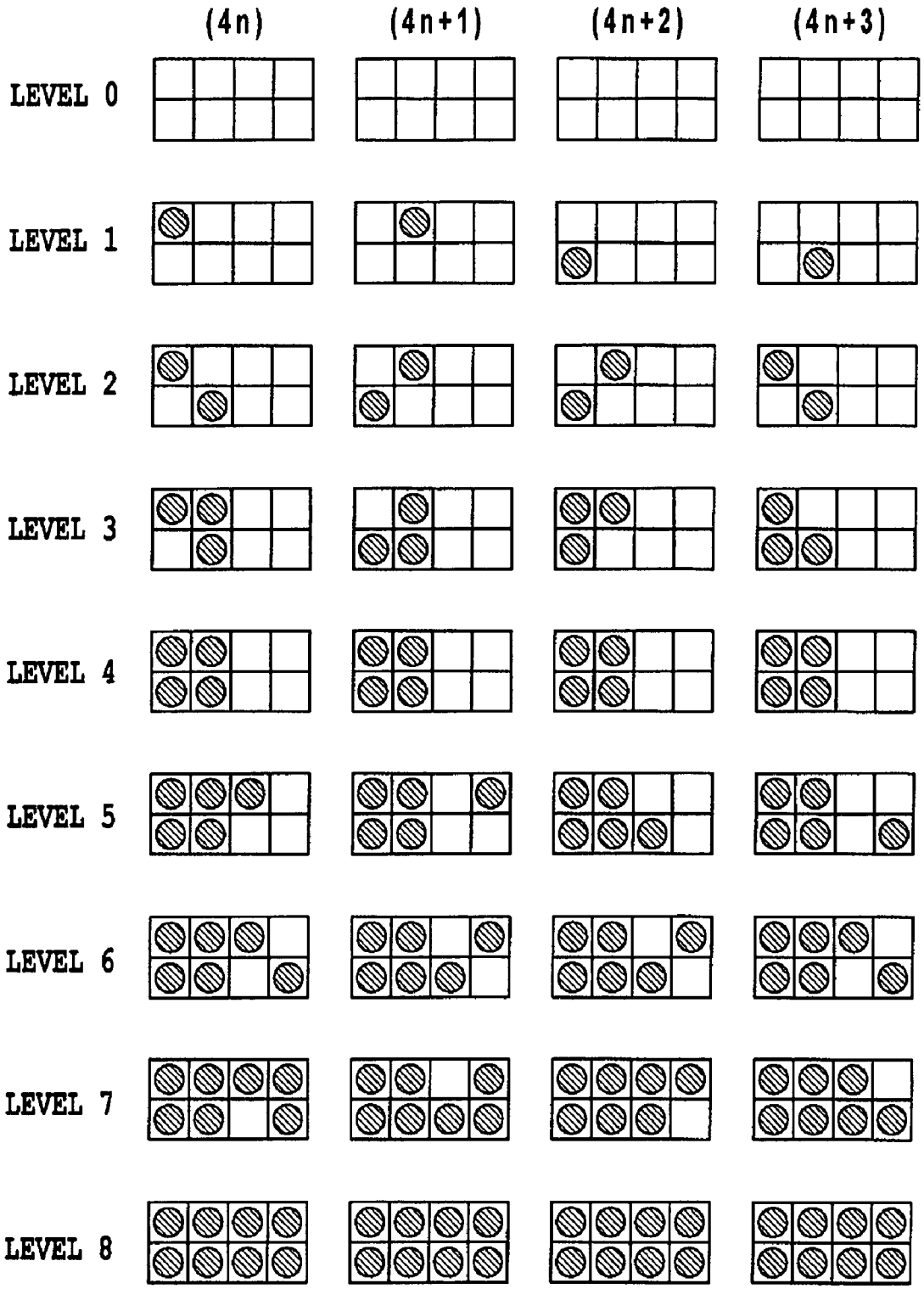
FIG. 3 is a diagram showing output patterns which correspond to input levels, and which are obtained by conversion in a dot arrangement patterning process in the printing apparatus used in the embodiment.

FIG. 3 shows output patterns corresponding to input levels 0 to 8. These output patterns are obtained through the conversion performed in the dot arrangement patterning process of the embodiment. Level numbers in the left column in the diagram correspond respectively to the levels 0 to 8 which are the outputted values from the half-toning process in the host apparatus. Regions each configured of 2 vertical areas×4 horizontal areas are shown to the right of this column. Each of the regions corresponds to a region occupied by one pixel receiving an output from the half-toning process. In addition, each of the areas in one pixel corresponds to a minimum unit for which it is specified whether the dot thereof should be on or off. Note that, in this description, a "pixel" means a minimum unit which is capable of representing a gradation, and also means a minimum unit to which the image processes (the precedent process, the subsequent process, the γ correction process, the half-toning process and the like) are applied using multi-valued data represented by the plurality of bits.

In this figure, an area in which a circle is drawn denotes an area where a dot is printed. As the level number increases, the number of dots to be printed increases one-by-one. In this embodiment, information on density of an original image is finally reflected in this manner.

From the left to the right, (4n) to (4n+3) denotes horizontal positions of pixels, each of which receives data on an image to be printed. An integer not smaller than 1 (one) is substituted for n in the expression (4n) to (4n+3). The patterns listed under the expression indicate that a plurality of mutually-different patterns are available depending on a position where a pixel is located even though the pixel receives an input at the same level. In other words, the configuration is that, even in a case where a pixel receives an input at one level, the four types of dot arrangement patterns under the expression (4n) to (4n+3) at the same level are assigned to the pixel in an alternating manner.

In FIG. 3, the vertical direction is a direction in which the ejection openings of the printing head are arrayed, and the horizontal direction is a direction in which the printing head moves. The configuration enabling a print to be made using the plurality of different dot arrangement patterns for one level brings about the following two effects. First, the number of times that ejection is performed can be equalized between two nozzles in which one nozzle is in charge of the patterns located in the upper row of the dot arrangement patterns at one level, and the other nozzle is in charge of the patterns located in the lower row of the dot arrangement patterns at the same level. Secondly, various noises unique to the printing apparatus can be disgregated.

When the above-described dot arrangement patterning process is completed, the assignment of dot arrangement patterns to the entire printing medium is completed.

(G) Mask Data Converting Process

In the foregoing dot arrangement patterning process J0007, whether or not a dot should be printed is determined for each of the areas on the printing medium. As a result, if binary data indicating the dot arrangement are inputted to a drive circuit J0009 of the printing head H1001, a desired image can be printed. In this case, what is termed as a one-pass print can be made. The one-pass print means that a print to be made for a single scan region on a printing medium is completed by the printing head H1001 moving once. Alternatively, what is termed as a multi-pass print can be made. The multi-pass print means that a print to be made for a single scan region on the printing medium is completed by the printing head moving a plurality of times. Here, descriptions will be provided for a mask data converting process, taking an example of the multi-pass print.

Figure 4:
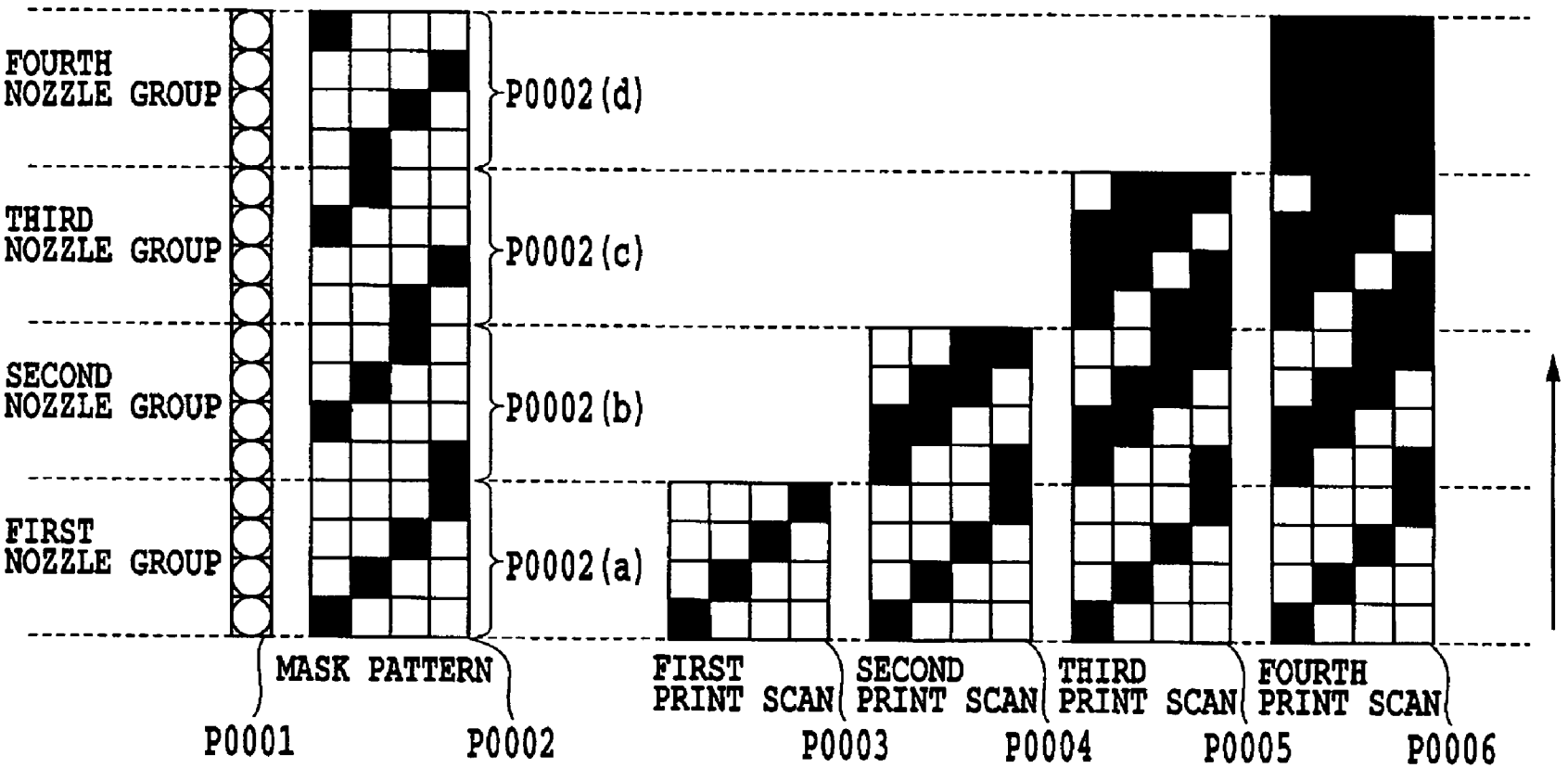
FIG. 4 is a schematic diagram for explaining a multi-pass printing method which is performed by the printing apparatus used in the embodiment.

FIG. 4 is a schematic diagram showing the printing head and print patterns for the purpose of describing the multi-pass printing method. The print head H1001 applied to this embodiment actually has 768 nozzles. For the sake of convenience, however, descriptions will be provided for the printing head and the print patterns, supposing that the printing head H1001 has 16 nozzles. The nozzles are divided into a first to a fourth nozzle groups. Each of the four nozzle groups includes four nozzles. Mask P0002 are configured of a first to a fourth mask patterns P0002(*a*) to P0002(*d*). The first to the fourth mask patterns P0002(*a*) to P0002(*d*) define the respective areas in which the first to the fourth nozzle groups are capable of making a print. Blackened areas in the mask patterns indicate printable areas, whereas whitened areas in the mask patterns indicate unprinted areas. The first to the fourth mask patterns are complementary to one another. The configuration is that, when these four mask patterns are superposed over one another, a print to be made in a region corresponding to a 4×4 area is completed.

Patterns denoted by reference numerals P0003 to P0006 show how an image is going to be completed by repeating a print scan. Each time a print scan is completed, the printing medium is transferred by a width of the nozzle group (a width of four nozzles in this figure) in a direction indicated by an arrow in the figure. In other words, the configuration is that an image in any same region (a region corresponding to the width of each nozzle region) on the printing medium is completed by repeating the print scan four times. Formation of an image in any same region on the printing medium by use of multiple nozzle groups by repeating the scan the plurality of times in the afore-mentioned manner makes it possible to bring about an effect of reducing variations characteristic of the nozzles, and an effect of reducing variations in accuracy in transferring the printing medium.

Figure 5:
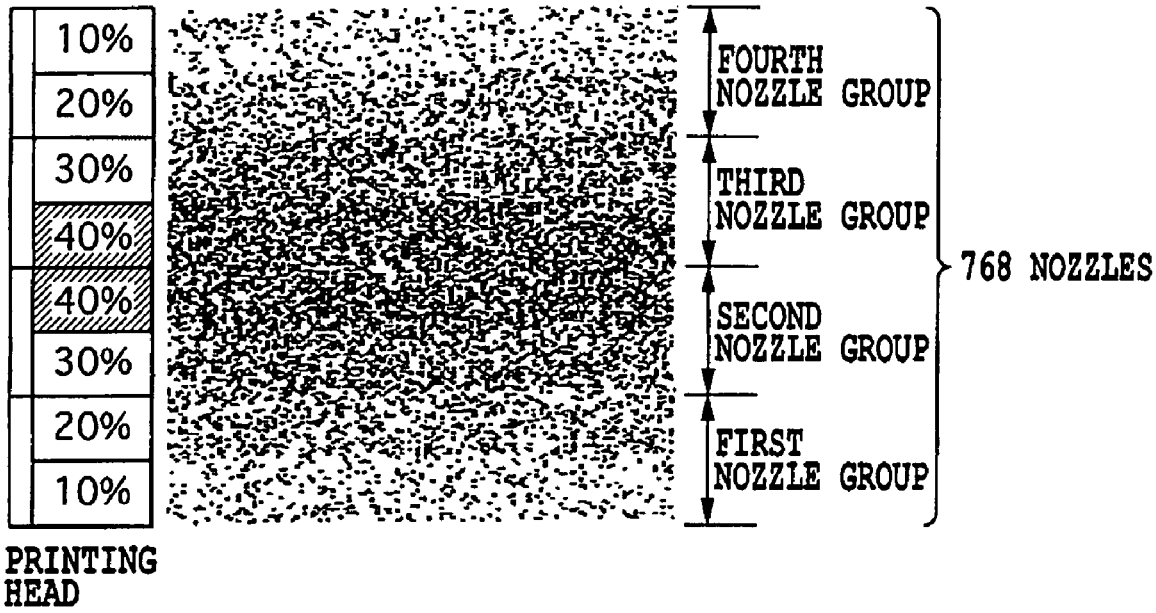
FIG. 5 is an explanatory diagram showing an example of mask patterns which are applied to the multi-pass printing method which is performed by the printing apparatus used in the embodiment.

FIG. 5 shows an example of mask which is capable of being actually applied to this embodiment. The printing head H1001 to which this embodiment is applied has 768 nozzles, and 192 nozzles belong to each of the four nozzle groups. As for the size of the mask, the mask has 768 areas in the vertical direction, and this number is equal to the number of nozzles. The mask has 256 areas in the horizontal direction. The mask has a configuration that the four mask patterns respectively corresponding to the four nozzle groups maintain a complementary relationship among themselves.

In the case of the ink jet printing head applied to this embodiment, which ejects a large number of fine ink droplets by means of a high frequency, it has been known that an air flow occurs in a neighborhood of the printing part during printing operation. In addition, it has been proven that this air flow particularly affects a direction in which ink droplets are ejected from nozzles located in the end portions of the printing head. For this reason, in the case of the mask patterns of this embodiment, a distribution of printable ratios is biased depending on which nozzle group a region belongs to, and on where a region is located in each of the nozzle groups, as seen from FIG. 5. As shown in FIG. 5, by employing the mask patterns having a configuration which makes the printable ratios of the nozzles in the end portions of the printing head smaller than those of nozzles in a central portion thereof, it is possible to make inconspicuous an adverse effect stemming from variations in positions where ink droplets ejected from the nozzles in the end portions of the printing head are landed.

Note that a printable ratio specified by a mask pattern is as follows. A printable ratio of a mask pattern is a percentage denomination of a ratio of the number of printable areas constituting the mask pattern (blackened areas in the mask pattern P0002(*a*) to P0002(*d*) of FIG. 4) to the sum of the number of printable areas and the number of unprintable areas constituting the mask pattern (the whitened areas in the mask patterns P0002(*a*) to P0002(*d*) of FIG. 4). In other words, a printable ratio (%) of a mask pattern is expressed by $$M \div (M+N) \times 100$$

where M denotes the number of printable areas constituting the mask pattern and N denotes the number of unprintable areas constituting the mask pattern.

In this embodiment, data for the mask as shown in FIG. 5 are stored in memory in the main body of the printing apparatus. The mask data converting process J0008 performs the AND process on the mask data with the binary data obtained in the foregoing dot arrangement patterning process. Thereby, binary data to be a print object in each print scan are determined. Subsequently, the binary data are transferred to the driving circuit J0009. Thus, the printing head H1001 is driven, and hence inks are ejected in accordance with the binary data.

FIG. 1 shows that the host apparatus J0012 is configured to perform the precedent process J0002, the subsequent process J0003, the γ correction process J0004, the half-toning process J0005 and the print data creation process J0006. In addition, FIG. 1 shows that the printing apparatus J0013 is designed to perform the dot arrangement patterning process J0007 and the mask data converting process J0008. However, the present invention is not limited to this embodiment. For example, the present invention may be carried out as an embodiment in which parts of the processes J0002 to J0005 are designed to be performed by the printing apparatus J0013 instead of by the host apparatus J0012. Otherwise, the present invention may be carried out as an embodiment in which all of these processes are designed to be performed by the host apparatus J0012. Alternately, the present invention may be carried out as an embodiment in which the processes J0002 to J0008 are designed to be performed by the printing apparatus J0013.

1.2 Configuration of Mechanisms

Descriptions will be provided for a configuration of the mechanisms in the printing apparatus to which this embodiment is applied. The main body of the printing apparatus of this embodiment is divided into a paper feeding section, a paper conveying section, a paper discharging section, a carriage section, a flat-pass printing section and a cleaning section from a viewpoint of functions performed by the mechanisms. These mechanisms are contained in an outer case.

Figure 6:
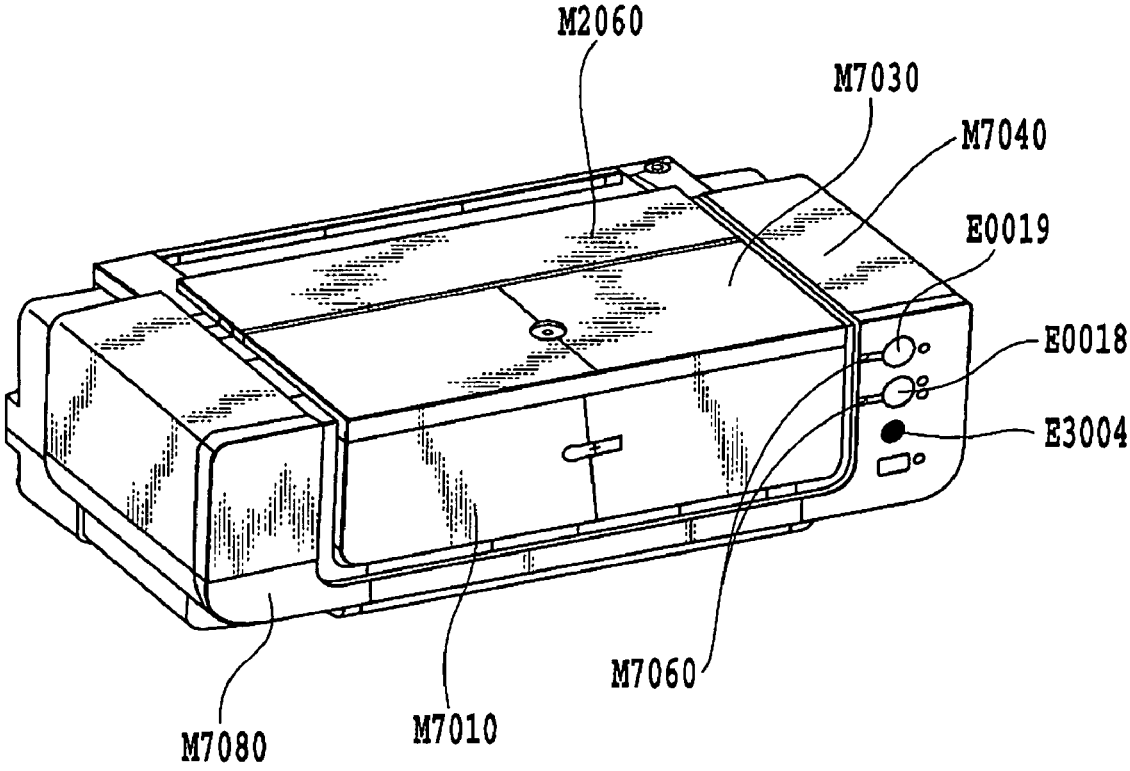
FIG. 6 is a perspective view of the printing apparatus used in the embodiment, and shows the printing apparatus in an unused condition when viewed from the front.
Figure 7:
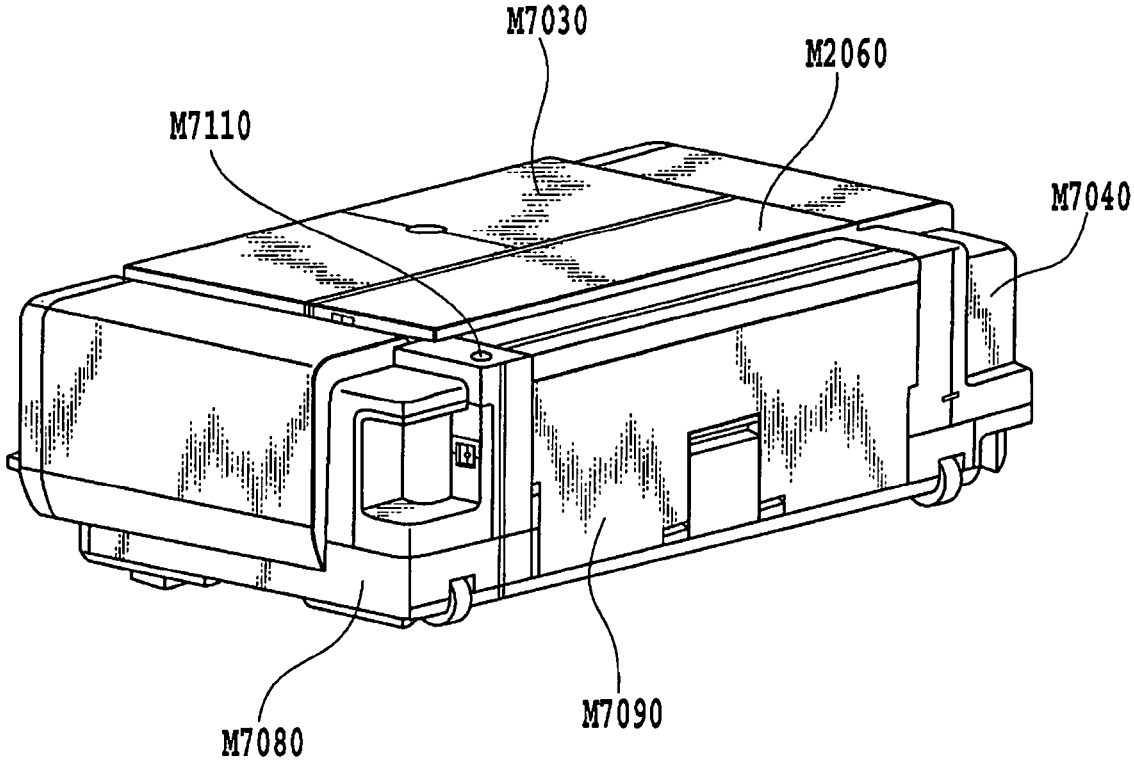
FIG. 7 is another perspective view of the printing apparatus used in the embodiment, and shows the printing apparatus in the unused condition when viewed from the back.
Figure 8:
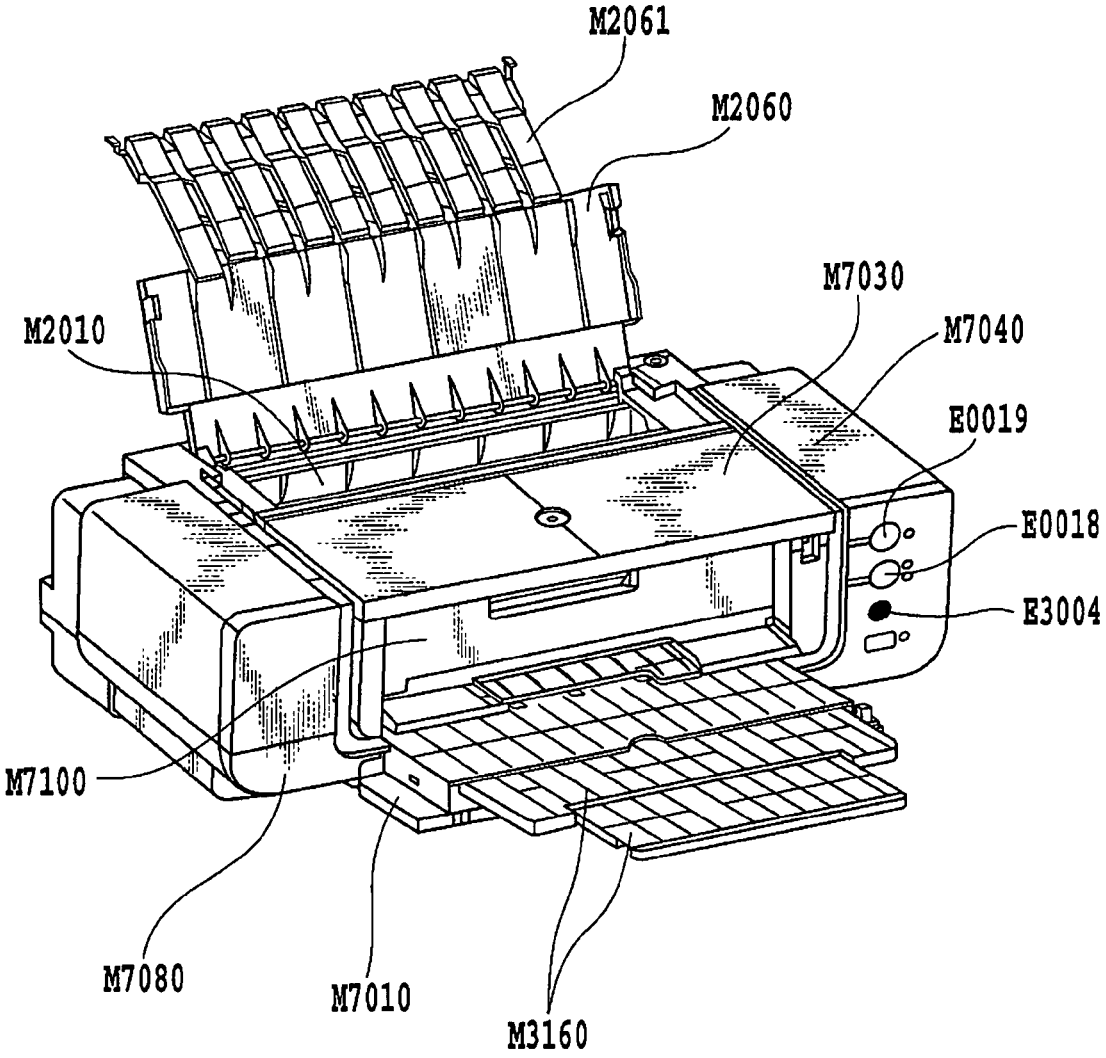
FIG. 8 is yet another perspective view of the printing apparatus used in the embodiment, and shows the printing apparatus in a used condition when viewed from the front.
Figure 9:
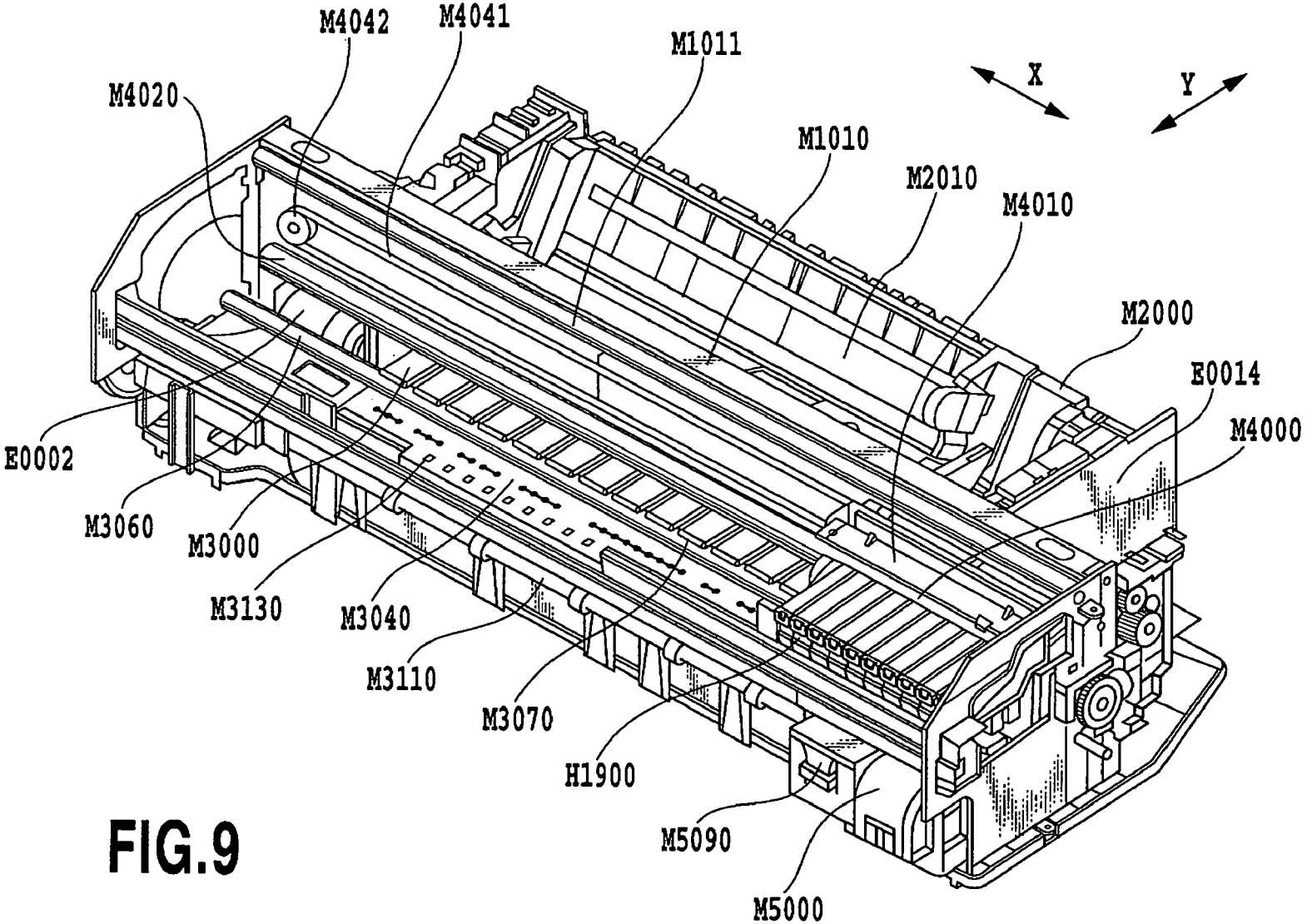
FIG. 9 is a diagram for explaining an internal mechanism of the main body of the printing apparatus used in the embodiment, and is a perspective view showing the printing apparatus when viewed from the right above.
Figure 10:
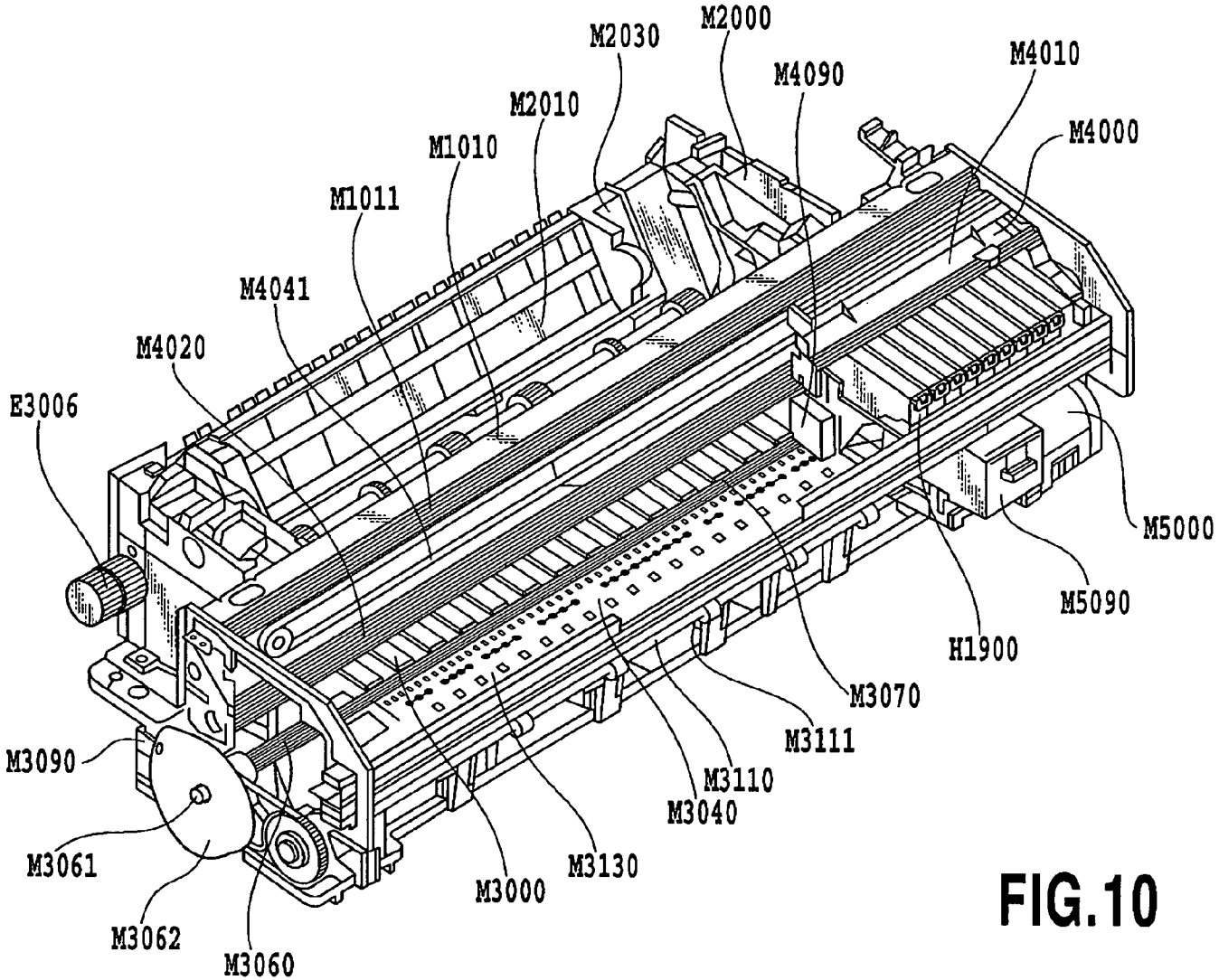
FIG. 10 is another diagram for explaining the internal mechanism of the main body of the printing apparatus used in the embodiment, and is another perspective view showing the printing apparatus when viewed from the left above.
Figure 11:
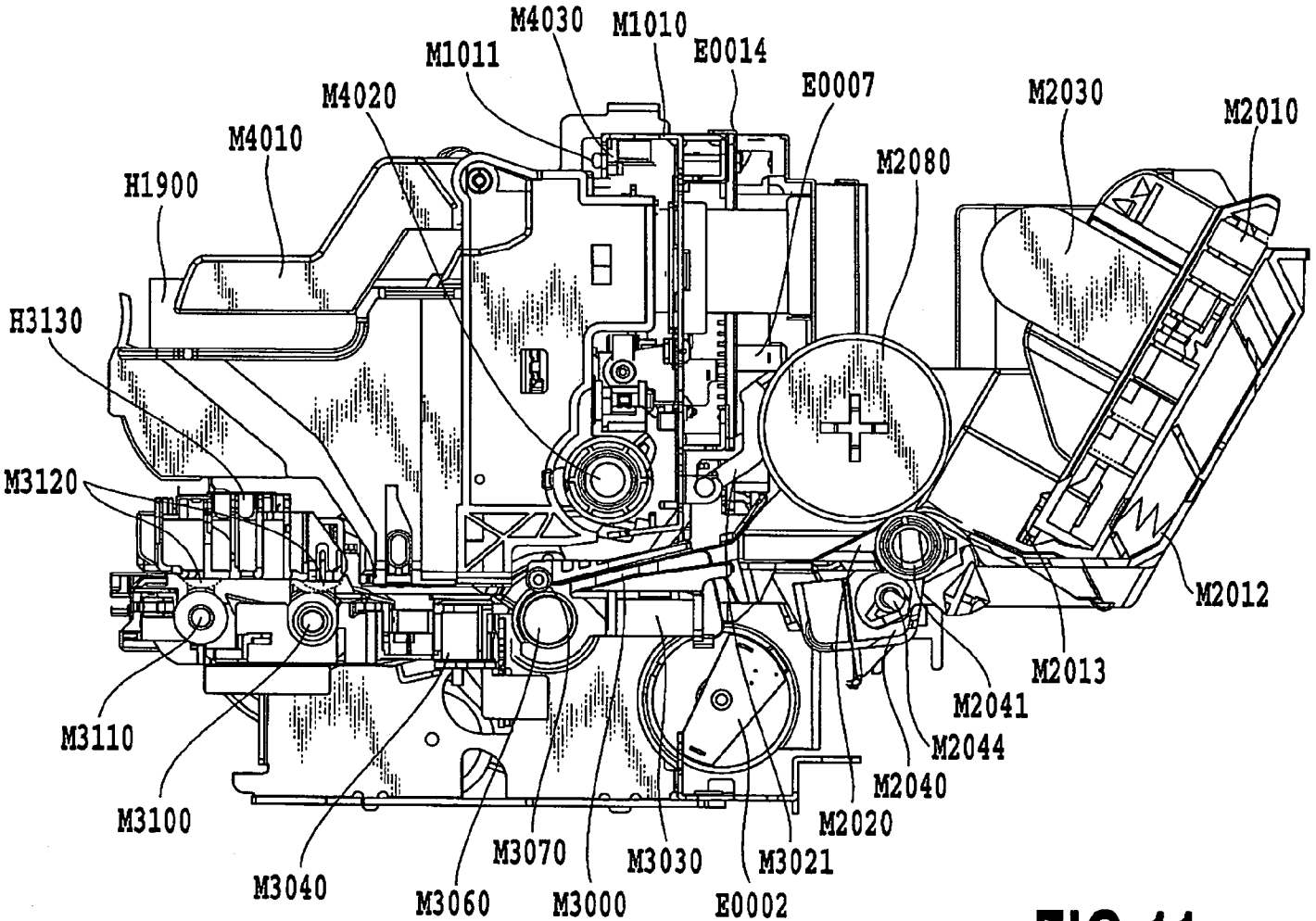
FIG. 11 is a side, cross-sectional view of the main body of the printing apparatus used in the embodiment for the purpose of explaining the internal mechanism of the main body of the printing apparatus.
Figure 12:
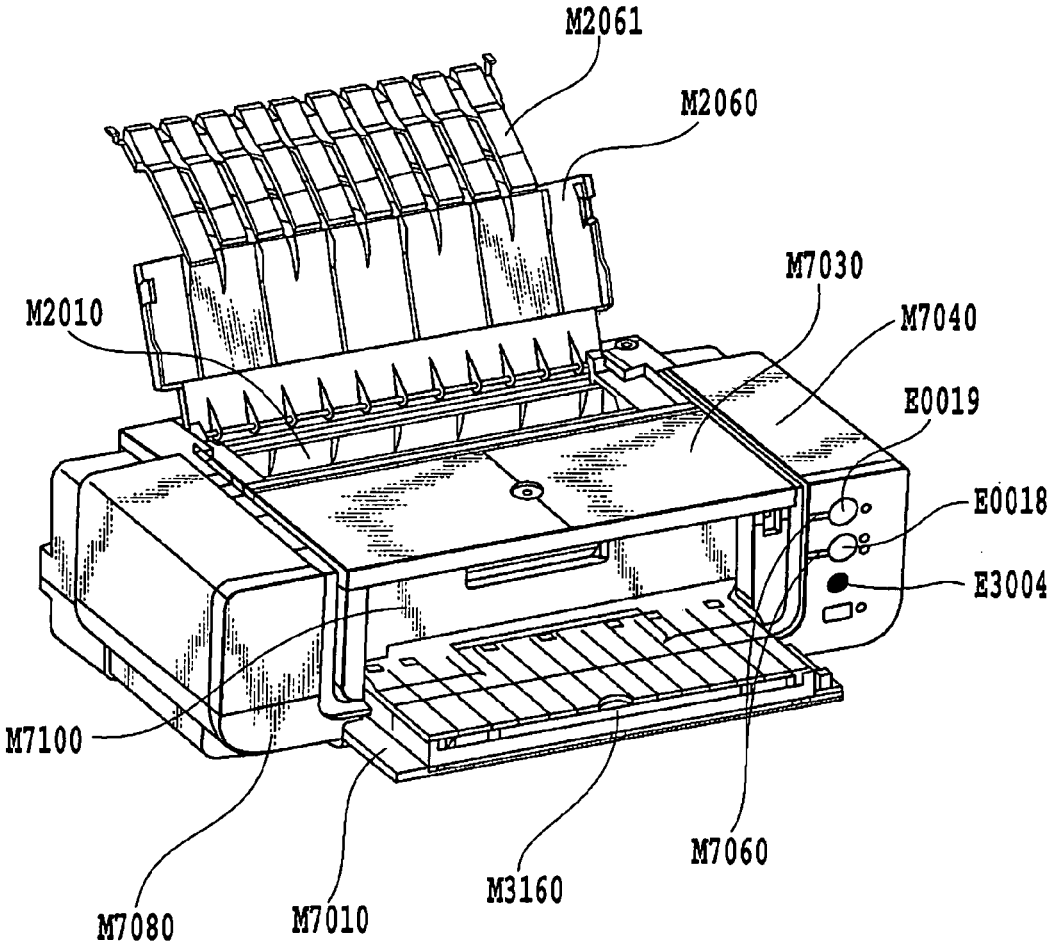
FIG. 12 is yet another perspective view of the printing apparatus used in the embodiment, and shows the printing apparatus in the process of performing a flat-pass printing operation when viewed from the front.
Figure 13:
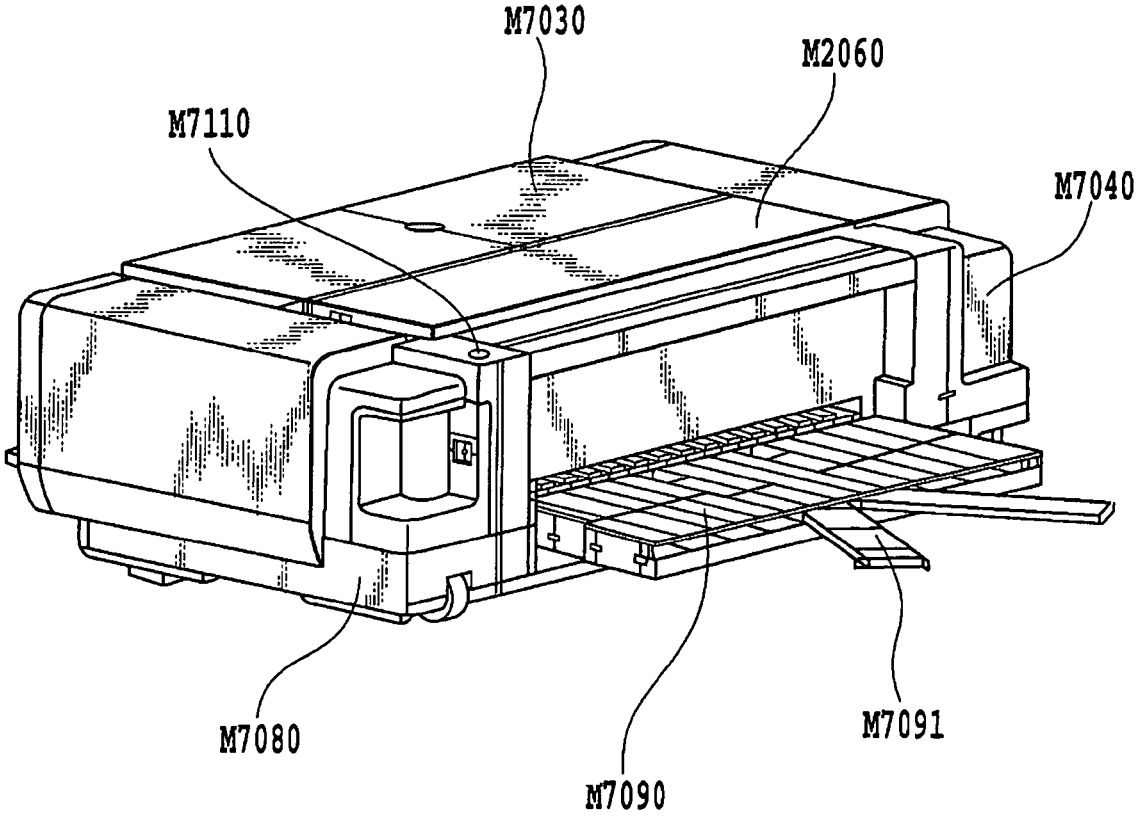
FIG. 13 is still another perspective view of the printing apparatus used in the embodiment, and shows the printing apparatus in the process of performing the flat-pass printing operation when viewed from the back.
Figure 14:
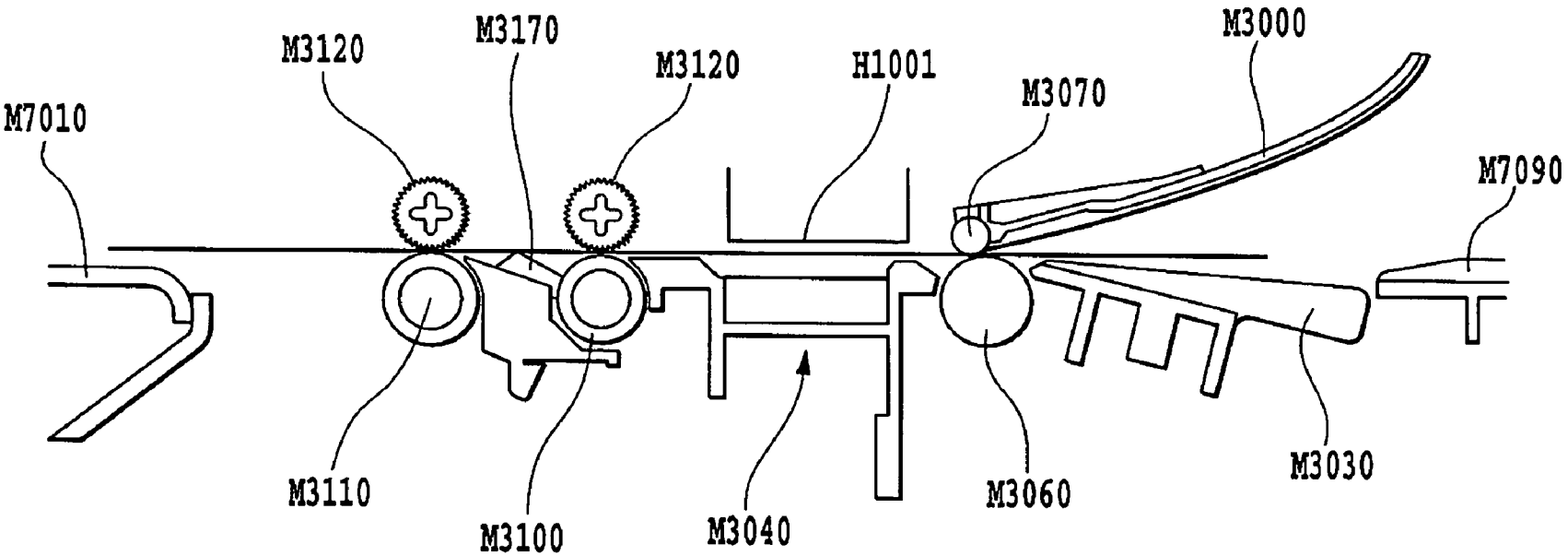
FIG. 14 is a schematic, side, cross-sectional view of the internal mechanism for explaining the flat-pass printing operation performed in the embodiment.
Figure 15:
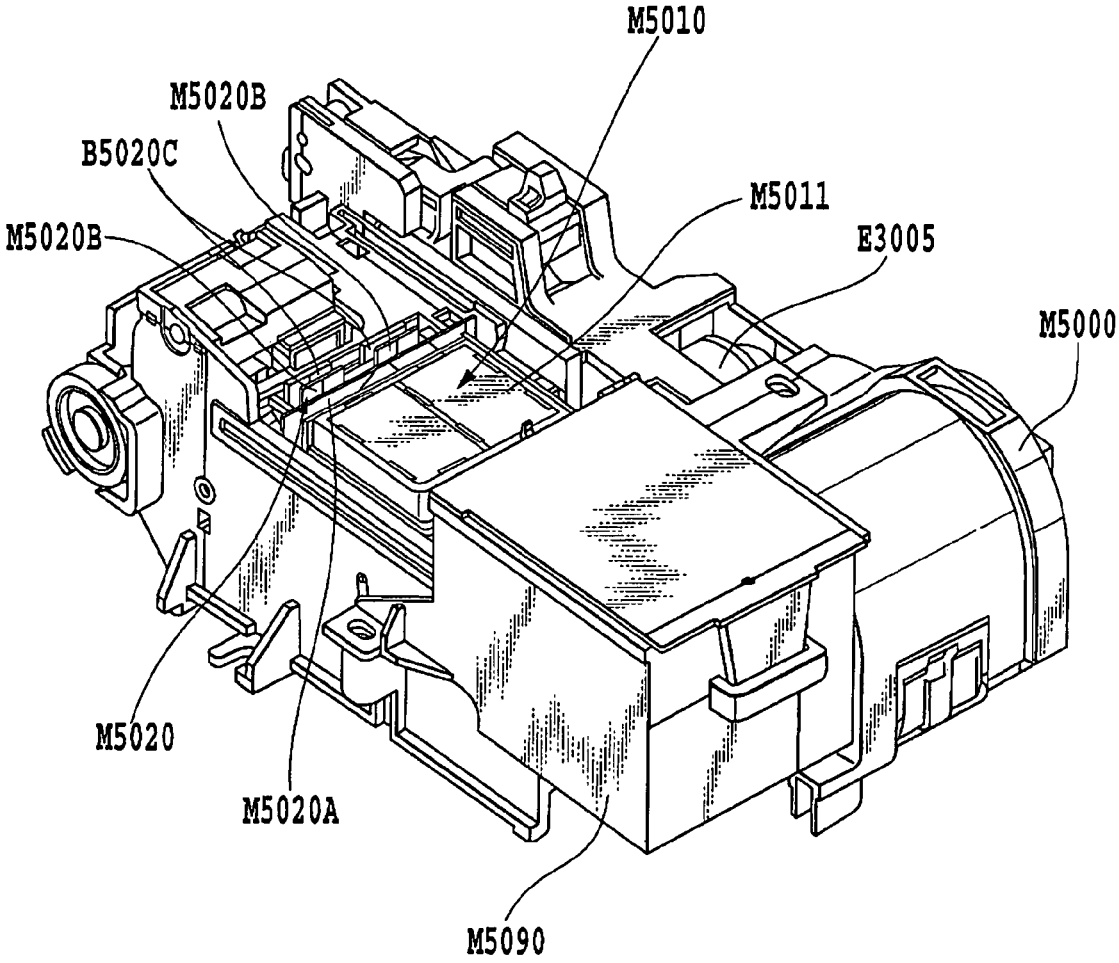
FIG. 15 is a perspective view showing a cleaning section in the main body of the printing apparatus used in the embodiment.
Figure 16:
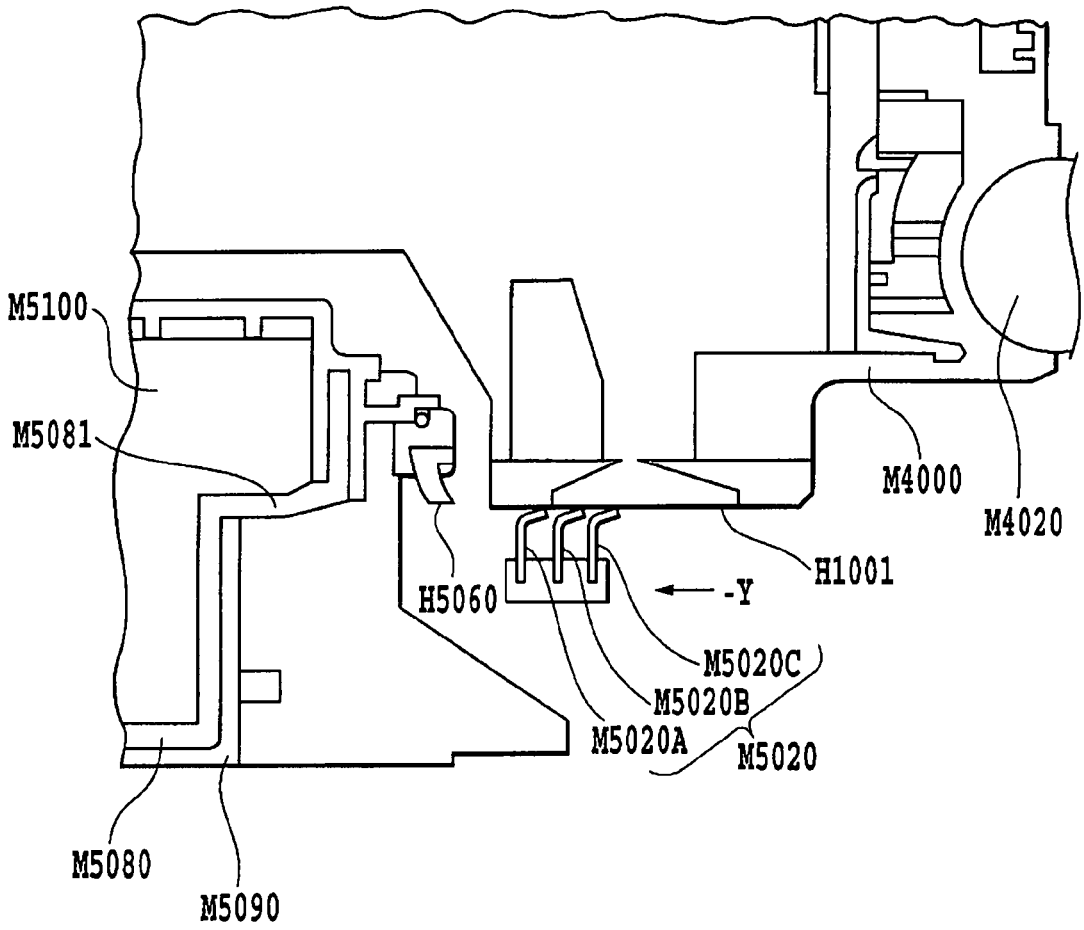
FIG. 16 is a cross-sectional view of a wiper portion in the cleaning section shown in FIG. 15 for explaining a configuration and an operation of the wiper portion.
Figure 17:
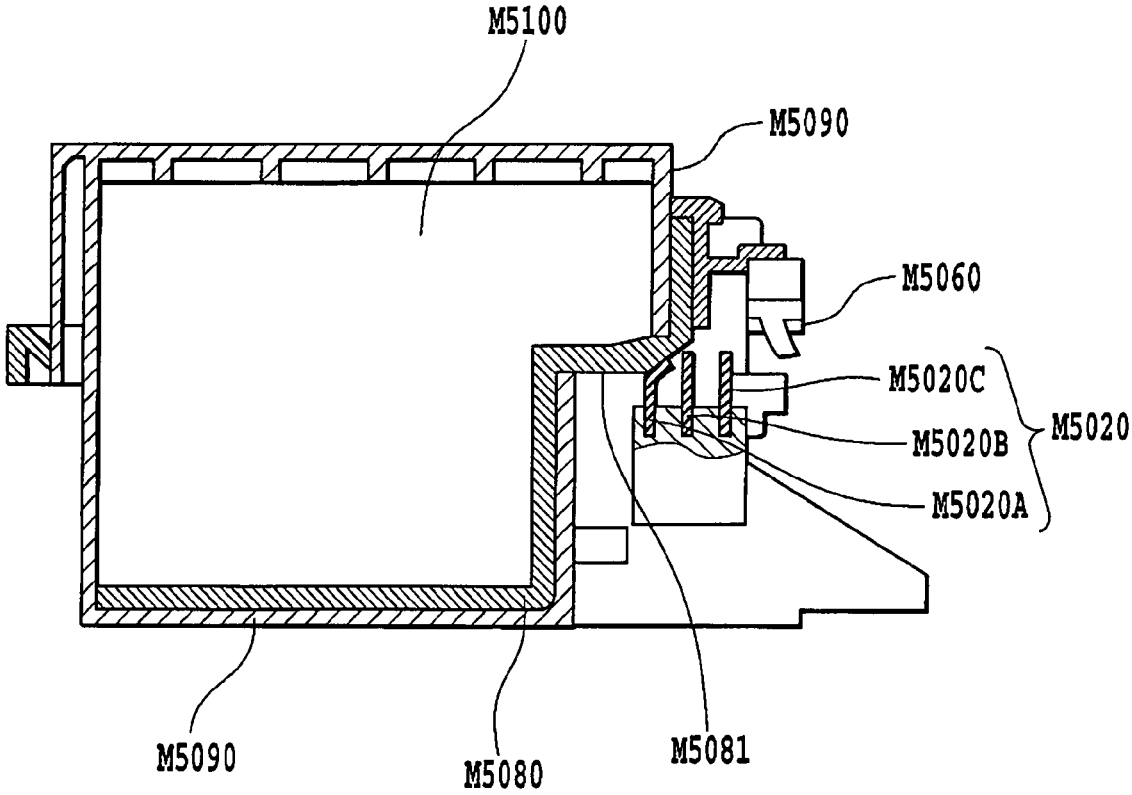
FIG. 17 is a cross-sectional view of a wetting liquid transferring unit in the cleaning section for explaining a configuration and an operation of the wetting liquid transferring unit.

FIGS. 6, 7, 8, 12 and 13 are perspective views respectively showing appearances of the printing apparatus to which this embodiment is applied. FIG. 6 shows the printing apparatus in an unused condition when viewed from the front. FIG. 7 shows the printing apparatus in an unused condition when viewed from the back. FIG. 8 shows the printing apparatus in a used condition when viewed from the front. FIG. 12 shows the printing apparatus during flat-pass printing when viewed from the front. FIG. 13 shows the printing apparatus during flat-pass printing when viewed from the back. In addition, FIGS. 9 to 11 and 14 to 16 are diagrams for describing internal mechanisms in the main body of the printing apparatus. In this respect, FIG. 9 is a perspective view showing the printing apparatus when viewed from the right above. FIG. 10 is a perspective view showing the printing apparatus when viewed from the left above. FIG. 11 is a side, cross-sectional view of the main body of the printing apparatus. FIG. 14 is a cross-sectional view of the printing apparatus during flat-pass printing. FIG. 15 is a perspective view of the cleaning section. FIG. 16 is a cross-sectional view for describing a configuration and an operation of a wiping mechanism in the cleaning section. FIG. 17 is a cross-sectional view of a wetting liquid transferring unit in the cleaning section.

Descriptions will be provided for each of the sections by referring to these figures whenever deemed necessary.

(A) Outer Case (Refer to FIGS. 6 and 7)

The outer case is attached to the main body of the printing apparatus in order to cover the paper feeding section, the paper conveying section, the paper discharging section, the carriage section, the cleaning section, the flat-pass section and the wetting liquid transferring unit. The outer case is configured chiefly of a lower case M7080, an upper case M7040, an access cover M7030, a connector cover, and a front cover M7010.

Paper discharging tray rails (not illustrated) are provided under the lower case M7080, and thus the lower case M7080 has a configuration in which a divided paper discharging tray M3160 is capable of being contained therein. In addition, the front cover M7010 is configured to close the paper discharging port while the printing apparatus is not used.

An access cover M7030 is attached to the upper case M7040, and is configured to be turnable. A part of the top surface of the upper case has an opening portion. The printing apparatus has a configuration in which each of ink tanks H1900 or the printing head H1001 (refer to FIG. 21) is replaced with a new one in this position. Incidentally, in the printing apparatus of this embodiment, the printing head H1001 has a configuration in which a plurality of ejecting portions are formed integrally into one unit. The plurality of ejecting portions corresponding respectively to a plurality of mutually different colors, and each of the plurality of ejecting portions is capable of ejecting an ink of one color. In addition, the printing head is configured as a printing head cartridge H1000 which the ink tanks H1900 are capable of being attached to, and detached from, independently of one another depending on the respective colors. The upper case M7040 is provided with a door switch lever (not illustrated), LED guides M7060, a power supply key E0018, a resume key E0019, a flat-pass key E3004 and the like. The door switch lever detects whether the access cover M7030 is opened or closed. Each of the LED guides M7060 transmits, and displays, light from the respective LEDs. Furthermore, a multi-stage paper feeding tray M2060 is turnably attached to the upper case M7040. While the paper feeding section is not used, the paper feeding tray M2060 is contained within the upper case M7040. Thus, the upper case M7040 is configured to function as a cover for the paper feeding section.

The upper case M7040 and the lower case M7040 are attached to each other by elastic fitting claws. A part provided with a connector portion therebetween is covered with a connector cover (not illustrated).

(B) Paper Feeding Section (Refer to FIGS. 8 and 11)

As shown in FIGS. 8 and 11, the paper feeding section is configured as follows. A pressure plate M2010, a paper feeding roller M2080, a separation roller M2041, a return lever M2020 and the like are attached to a base M2000. The pressure plate M2010 is that on which printing media are stacked. The paper feeding roller M2080 feeds the printing media sheet by sheet. The separation roller M2041 separates a printing medium. The return lever M2020 is used for returning the printing medium to a stacking position.

(C) Paper Conveying Section (Refer to FIGS. 8 to 11)

A conveying roller M3060 for conveying a printing medium is rotatably attached to a chassis M1010 made of an upwardly bent plate. The conveying roller M3060 has a configuration in which the surface of a metal shaft is coated with ceramic fine particles. The conveying roller M3060 is attached to the chassis M1010 in a state in which metallic parts respectively of the two ends of the shaft are received by bearings (not illustrated). The conveying roller M3060 is provided with a roller tension spring (not illustrated). The roller tension spring pushes the conveying roller M3060, and thereby applies an appropriate amount of load to the conveying roller M3060 while the conveying roller M3060 is rotating. Accordingly, the conveying roller M3060 is capable of conveying printing medium stably.

The conveying roller M3060 is provided with a plurality of pinch rollers M3070 in a way that the plurality of pinch rollers M3070 abut on the conveying roller M3060. The plurality of pinch rollers M3070 are driven by the conveying roller M3060. The pinch rollers M3070 are held by a pinch roller holder M3000. The pinch rollers M3070 are pushed respectively by pinch roller springs (not illustrated), and thus are brought into contact with the conveying roller M3060 with the pressure. This generates a force for conveying printing medium. At this time, since the rotation shaft of the pinch roller holder M3000 is attached to the bearings of the chassis M1010, the rotation shaft rotates thereabout.

A paper guide flapper M3030 and a platen M3040 are disposed in an inlet to which a printing medium is conveyed. The paper guide flapper M3030 and the platen M3040 guide the printing medium. In addition, the pinch roller holder M3000 is provided with a PE sensor lever M3021. The PE sensor lever M3021 transmits a result of detecting the front end or the rear end of each of the printing medium to a paper end sensor (hereinafter referred to as a "PE sensor") E0007 fixed to the chassis M1010. The platen M3040 is attached to the chassis M1010, and is positioned thereto. The paper guide flapper M3030 is capable of rotating about a bearing unit (not illustrated), and is positioned to the chassis M1010 by abutting on the chassis M1010.

The printing head H1001 (refer to FIG. 21) is provided at a side downstream in a direction in which the conveying roller M3060 conveys the printing medium.

Descriptions will be provided for a process of conveying printing medium in the printing apparatus with the foregoing configuration. A printing medium sent to the paper conveying section is guided by the pinch roller holder M3000 and the paper guide flapper M3030, and thus is sent to a pair of rollers which are the conveying roller 3060 and the pinch roller M3070. At this time, the PE sensor lever M3021 detects an edge of the printing medium. Thereby, a position in which a print is made on the printing medium is obtained. The pair of rollers which are the conveying roller M3060 and the pinch roller M3070 are driven by an LF motor E0002, and are rotated. This rotation causes the printing medium to be conveyed over the platen M3040. A rib is formed in the platen M3040, and the rib serves as a conveyance datum surface. A gap between the printing head H1001 and the surface of the printing medium is controlled by this rib. Simultaneously, the rib also suppresses flapping of the printing medium in cooperation with the paper discharging section which will be described later.

A driving force with which the conveying roller M3060 rotates is obtained by transmitting a torque of the LF motor E0002 consisting, for example, of a DC motor to a pulley M3061 disposed on the shaft of the conveying roller M3060 through a timing belt (not illustrated). A code wheel M3062 for detecting an amount of conveyance performed by the conveying roller M3060 is provided on the shaft of the conveying roller M3060. In addition, an encode sensor M3090 for reading a marking formed in the code wheel M3062 is disposed in the chassis M1010 adjacent to the code wheel M3062. Incidentally, the marking formed in the code wheel M3062 is assumed to be formed at a pitch of 150 to 300 lpi (line/inch) (an example value).

(D) Paper Discharging Section (Refer to FIGS. 8 to 11)

The paper discharging section is configured of a first paper discharging roller M3100, a second paper discharging roller M3110, a plurality of spurs M3120 and a gear train.

The first paper discharging roller M3100 is configured of a plurality of rubber portions provided around the metal shaft thereof. The first paper discharging roller M3100 is driven by transmitting the driving force of the conveying roller M3060 to the first paper discharging roller M3100 through an idler gear.

The second paper discharging roller M3110 is configured of a plurality of elastic elements M3111, which are made of elastomer, attached to the resin-made shaft thereof. The second paper discharging roller M3110 is driven by transmitting the driving force of the first paper discharging roller M3100 to the second paper discharging roller M3110 through an idler gear.

Each of the spurs M3120 is formed by integrating a circular thin plate and a resin part into one unit. A plurality of convex portions are provided to the circumference of each of the spurs M3120. Each of the spurs M3120 is made, for example, of SUS. The plurality of spurs M3120 are attached to a spur holder M3130. This attachment is performed by use of a spur spring obtained by forming a coiled spring in the form of a stick. Simultaneously, a spring force of the spur spring causes the spurs M3120 to abut respectively on the paper discharging rollers M3100 and M3110 at predetermined pressures. This configuration enables the spurs 3120 to rotate to follow the two paper discharging rollers M3100 and M3110. Some of the spurs M3120 are provided at the same positions as corresponding ones of the rubber portions of the first paper discharging roller M3110 are disposed, or at the same positions as corresponding ones of the elastic elements M3111 are disposed. These spurs chiefly generate a force for conveying printing medium. In addition, others of the spurs M3120 are provided at positions where none of the rubber portions and the elastic elements M3111 is provided. These spurs M3120 chiefly suppresses lift of a printing medium while a print is being made on the printing medium.

Furthermore, the gear train transmits the driving force of the conveying roller M3060 to the paper discharging rollers M3100 and M3110.

With the foregoing configuration, a printing medium on which an image is formed is pinched with nips between the first paper discharging roller M3110 and the spurs M3120, and thus is conveyed. Accordingly, the printing medium is delivered to the paper discharging tray M3160. The paper discharging tray M3160 is divided into a plurality of parts, and has a configuration in which the paper discharging tray M3160 is capable of being contained under the lower case M7080 which will be described later. When used, the paper discharging tray M3160 is drawn out from under the lower case M7080. In addition, the paper discharging tray M3160 is designed to be elevated toward the front end thereof, and is also designed so that the two side ends thereof are held at a higher position. The design enhances the stackability of printing media, and prevents the printing surface of each of the printing media from being rubbed.

(E) Carriage Section (Refer to FIGS. 9 to 11)

The carriage section includes a carriage M4000 to which the printing head H1001 is attached. The carriage M4000 is supported with a guide shaft M4020 and a guide rail M1011. The guide shaft M4020 is attached to the chassis M1010, and guides and supports the carriage M4000 so as to cause the carriage M4000 to perform reciprocating scan in a direction perpendicular to a direction in which a printing medium is conveyed. The guide rail M1011 is formed in a way that the guide rail M1011 and the chassis M1010 are integrated into one unit. The guide rail M1011 holds the rear end of the carriage M4000, and thus maintains the space between the printing head H1001 and the printing medium. A slide sheet M4030 formed of a thin plate made of stainless steel or the like is stretched on a side of the guide rail M1011, on which side the carriage M4000 slides. This makes it possible to reduce sliding noises of the printing apparatus.

The carriage M4000 is driven by a carriage motor E0001 through a timing belt M4041. The carriage motor E0001 is attached to the chassis M1010. In addition, the timing belt M4041 is stretched and supported by an idle pulley M4042. Furthermore, the timing belt M4041 is connected to the carriage M4000 through a carriage damper made of rubber. Thus, image unevenness is reduced by damping the vibration of the carriage motor E0001 and the like.

An encoder scale E0005 for detecting the position of the carriage M4000 is provided in parallel with the timing belt M4041 (the encoder scale E0005 will be described later by referring to FIG. 18). Markings are formed on the encoder scale E0005 at pitches in a range of 150 lpi to 300 lpi. An encoder sensor E0004 for reading the markings is provided on a carriage board E0013 installed in the carriage M4000 (the encoder sensor E0004 and the carriage board E0013 will be described later by referring to FIG. 18). A head contact E0101 for electrically connecting the carriage board E0013 to the printing head H1001 is also provided to the carriage board E0013. Moreover, a flexible cable E0012 (not illustrated) is connected to the carriage M4000 (the flexible cable E0012 will be described later by referring to FIG. 18). The flexible cable E0012 is that through which a drive signal is transmitted from an electric substrate E0014 to the printing head H1001.

As for components for fixing the printing head H1001 to the carriage M4000, the following components are provided to the carriage M4000. An abutting part (not illustrated) and pressing means (not illustrated) are provided on the carriage M4000. The abutting part is with which the printing head H1001 positioned to the carriage M4000 while pushing the printing head H1001 against the carriage M4000. The pressing means is with which the printing head H1001 is fixed at a predetermined position. The pressing means is mounted on a headset lever M4010. The pressing means is configured to act on the printing head H1001 when the headset lever M4010 is turned about the rotation support thereof in a case where the printing head H1001 is intended to be set up.

Moreover, a position detection sensor M4090 including a reflection-type optical sensor is attached to the carriage M4000. The position detection sensor is used while a print is being made on a special medium such as a CD-R, or when a print result or the position of an edge of a sheet of paper is being detected. The position detection sensor M4090 is capable of detecting the current position of the carriage M4000 by causing a light emitting device to emit light and by thus receiving the emitted light after reflecting off the carriage M4000.

In a case where an image is formed on a printing medium in the printing apparatus, the set of the conveying roller M3060 and the pinch rollers M3070 transfers the printing medium, and thereby the printing medium is positioned in terms of a position in a column direction. In terms of a position in a row direction, by using the carriage motor E0001 to move the carriage M4000 in a direction perpendicular to the direction in which the printing medium is conveyed, the printing head H1001 is located at a target position where an image is formed. The printing head H1001 thus positioned ejects inks onto the printing medium in accordance with a signal transmitted from the electric substrate E0014. Descriptions will be provided later for details of the configuration of the printing head H1001 and a printing system. The printing apparatus of this embodiment alternately repeats a printing main scan and a sub-scan. During the printing main scan, the carriage M4000 scans in the row direction while the printing head H1001 is making a print. During the sub-scan, the printing medium is conveyed in the column direction by conveying roller M3060. Thereby, the printing apparatus is configured to form an image on the printing medium.

(F) Flat-pass Printing Section (Refer to FIGS. 12 to 14)

A printing medium is fed from the paper feed section in a state where the printing medium is bent, because the passage through which the printing medium passes continues curving up to the pinch rollers as shown in FIG. 11. For this reason, if a thicker printing medium with a thickness of approximately 0.5 mm or more, for example, is attempted to be fed from the paper feeding section, a reaction force of the bent printing medium occurs, and thus resistance to the paper feeding increases. As a result, it is likely that the printing medium cannot be fed. Otherwise, even if the printing medium can be fed, the delivered printing medium remains bent, or is folded.

A flat-pass print is made on printing media, such as thicker printing media, which a user does not wish to fold, and on printing media, such as CD-Rs, which cannot be bent.

Types of flat-pass prints include a type of print made by manually supplying a printing medium from a slit-shaped opening portion (under a paper feeding unit) in the back of the main body of a printing apparatus, and by thus causing pinch rollers of the main body to nip the printing medium. However, the flat-pass print of this embodiment employs the following mode. A printing medium is fed from the paper discharging port located in the front side of the main body of the printing apparatus to a position where a print is going to be made, and the print is made on the printing medium by switching back the printing medium.

The front cover M7010 is usually located below the paper discharging section, because the front cover M7010 is also used as a tray in which several tens of printing media on which prints have been made are stacked (refer to FIG. 8). When a flat-pass print is going to be made, the front tray M7010 is elevated up to a position where the paper discharging port is located (refer to FIG. 12) for the purpose of supplying a printing medium from the paper discharging port horizontally in a direction reverse to the direction in which a printing medium is usually conveyed. Hooks and the like (not illustrated) are provided to the front cover M7010. Thus, the front cover M7010 is capable of being fixed to a position where the printing medium is supplied for the purpose of the flat-pass print. It can be detected by a sensor whether or not the front cover M7010 is located at the position where the printing medium is supplied for the purpose of the flat-pass print. Depending on this detection, it can be determined whether the printing apparatus is in a flat-pass printing mode.

In the case of the flat-pass printing mode, first of all, a flat-pass key E3004 is operated for the purpose of placing a printing medium on the front tray M7010 and inserting the printing medium from the paper discharging port. Thereby, a mechanism (not illustrated) lifts the spur holder M3130 and the pinch roller holder M3000 respectively up to positions higher than a presumed thickness of the printing medium. In addition, in a case where the carriage M4000 exists in an area through which the printing medium is going to pass, a lifting mechanism (not illustrated) lifts the carriage M4000 up. This makes it easy to insert the printing medium therein. Moreover, by pressing a rear tray button M7110, a rear tray M7090 can be opened. Furthermore, a rear sub-tray M7091 can be opened in the form of the letter V (refer to FIG. 13). The rear tray M7090 and the rear sub-tray M7091 are trays with which a long printing medium is supported in the back of the main body of the printing apparatus. This is because, if the long printing medium is inserted from the front of the main body of the printing apparatus, the long printing medium juts out of the back of the main body of the printing apparatus. If a thicker printing medium is not kept flat while a print is being made on the thicker printing medium, the thicker printing medium may be rubbed against the head ejection face, or the conveyance load may change. This is likely to adversely affect the print quality. For this reason, the disposition of these trays is effective. However, if a printing medium is not long enough to jut out of the back of the main body of the printing apparatus, the rear tray M7090 and the like need not be opened.

In the foregoing manner, a printing medium can be inserted from the paper discharging port to the inside of the main body of the printing apparatus. A printing medium is positioned on the front tray M7010 by aligning the rear edge (an edge at the side located closest to a user) and the right edge of the printing medium to a position in the front tray M7010 where a marker is formed.

At this time, if the flat-pass key E3004 is operated once again, the spur holder M3130 comes down, and thus the paper discharging rollers M3100, M3110 and the spurs M3120 jointly nip the printing medium. Thereafter, the paper discharging rollers M3100 and M3110 draw the printing medium into the main body of the printing apparatus by a predetermined amount thereof (in a direction reverse to the direction in which the printing medium is conveyed during normal printing). Because the edge at the side closest to the user (the rear edge) of a printing medium is aligned to the marker when the printing medium is set up at the beginning, it is likely that the front edge (the edge located farthest from a user) of the printing medium may not reach the conveying roller M3060, if the printing medium is shorter. With this taken into consideration, the predetermined amount is defined as a distance between the rear edge of a printing medium with the presumably shortest length and the conveying roller M3060. Once a printing medium is transferred by the predetermined amount, the rear edge of the printing medium reaches the conveying roller M3060. Thus, the pinch roller holder M3000 is lowered at the position, and the conveying roller M3060 and the pinch rollers M3070 are caused to nip the printing medium. Subsequently, the printing medium is further transferred so that the rear edge of the printing medium is nipped by the conveying roller M3060 and the pinch rollers M3070. Thereby, the supplying of the printing medium for the purpose of the flat-pass print is completed (at a position where the printing medium waits for a print to be made thereon).

A nip force with which the paper discharging roller M3100 and M3110 as well as the spurs M3120 nip a printing medium is set relatively weak lest the force should adversely affect image formation while the printing medium is being delivered during a normal print. For this reason, in the case where a flat-pass print is going to be made, it is likely that the position of the printing medium shifts before the print starts. In this embodiment, however, a printing medium is nipped by the conveying roller M3060 and the pinch rollers M3070 which have a relatively stronger nip force. This secures a position where a printing medium should be set. In addition, while a printing medium is being conveyed into the inside of the main body by the predetermined amount, a flat-pass paper detection sensor lever (hereinafter referred to as an "FPPE sensor lever") M3170 blocks or forms a light path of an FPPE sensor E9001 which is an infrared-ray sensor, and which is not illustrated here. Thereby, the position of the rear edge (the position of the front edge during the print) of the printing medium can be detected. Incidentally, the FPPE sensor lever may be rotatably provided between the platen M3040 and the spur holder M3130.

Once a printing medium is set at the position where the printing medium waits for a print to be made thereon, a print command is executed. Specifically, the conveying roller M3060 conveys the printing medium to a position where the printing head H1001 is going to make a print on the printing medium. Thereafter, the print is made in the same manner as a normal printing operation is performed. After the print, the printing medium is discharged to the front tray M7010.

In a case where the flat-pass print is intended to be made successively, the printing medium on which the print has been made is removed from the front tray M7010, and the next printing medium is set thereon. After that, it is sufficient that the foregoing processes are repeated. Specifically, the subsequent print starts with the setting of a printing medium after the spur holder M3130 and the pinch roller holder M3000 are lifted up by pressing the flat-pass key E3004.

On the other hand, in a case where the flat-pass print is intended to be completed, the printing apparatus is returned to the normal printing mode by returning the front tray M7010 to the normal print position.

(G) Cleaning Section (Refer to FIGS. 15 and 16)

The cleaning section is a mechanism for cleaning the printing head H1001. The cleaning section is configured of a pump M5000, caps M5010, a wiper portion M5020 and the like. The caps M5010 are those which prevent the printing head H1001 from being dried out. The wiper portion M5020 is used for cleaning the surface of the printing head H1001 on which the ejection openings are formed.

Figure 18:
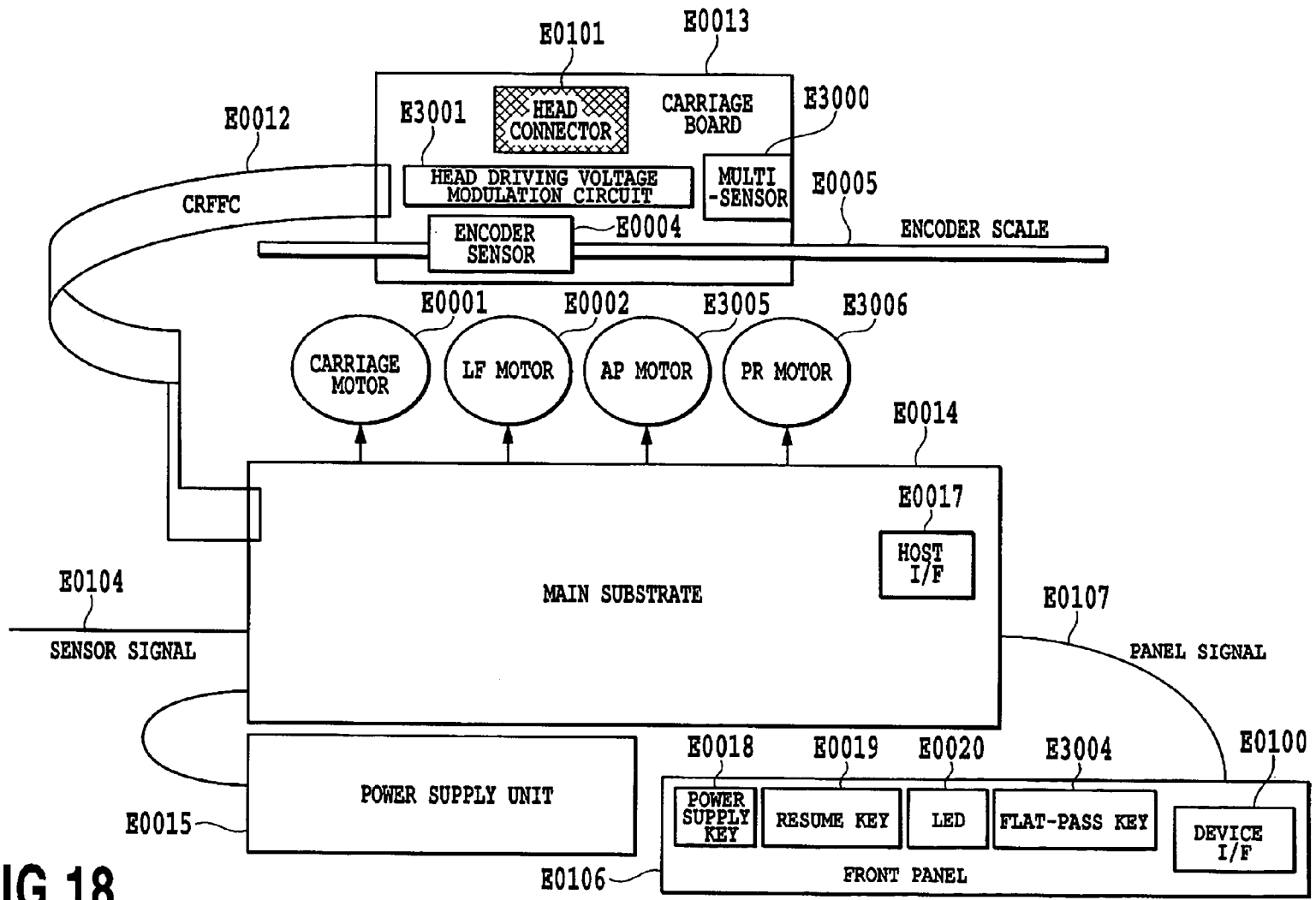
FIG. 18 is a block diagram schematically showing the entire configuration of an electrical circuit in the embodiment of the present invention.

In the case of this embodiment, a chief driving force of the cleaning section is transmitted from an AP motor E3005 (see FIG. 18). The pump M5000 is designed to be operated by rotation in one direction which is generated by means of a one-way clutch (not illustrated). The wiper portion M5020 and the caps M5010 are designed to ascend and descend by rotation in the other direction which is generated by the one-way clutch Incidentally, the AP motor E3005 is also used as a driving power supply for an operation of feeding printing medium, but a motor specialized for operating the cleaning section may be provided to the cleaning section instead.

The motor E0003 drives the caps M5010 so as for the caps M5010 to be capable of ascending and descending by means of an ascending/descending mechanism (not illustrated). When the caps M5010 go up to an ascending position, the caps M5010 cap each of the ejection faces of several ejecting portions provided to the printing head H1001. While no print operation is being performed, the caps M5010 can protect the printing head H1001. Otherwise, the caps M5010 can recover the printing head H1001 by suction. While a print operation is being performed, the caps M5010 can be placed in a descending position which prevents the caps M5010 from interfering with the printing head H1001. In addition, by opposing the caps M5010 to the ejection face, the caps M5010 are capable of receiving preliminary ejections. In a case where, for instance, the printing head H1001 is provided with ten ejecting portions, two caps M5010 are provided to the cleaning section in the illustrated example so that the ejection face corresponding to each five ejecting portions can be capped collectively by corresponding one of the two caps M5010.

A wiper portion M5020 made of an elastic member such as rubber is fixed to a wiper holder (not illustrated). The wiper holder is capable of moving in directions indicated by −Y and +Y in FIG. 16 (−Y and +Y are directions in which the ejection openings in the ejecting portions are arranged). When the printing head H1001 gets to the home position, the wiper holder moves in the direction indicated by an arrow −Y. Thereby, a surface of the printing head H1001 can be wiped. Once the wiping operation is completed, the carriage is caused to escape out of the range where the wiping operation is designed to be performed, and thus the wiper is returned to a position which prevents the wiper from interfering with the ejection face and the like. Incidentally, the wiper portion M5020 of this example is provided with a wiper blade M5020A for wiping the entire surface of the printing head H1001 including all of the ejection faces of the ejecting portions. In addition, the wiper portion M5020 is provided with the other two wiper blades M5020B and M5020C. The wiper blade M5020B wipes vicinities of nozzles for ejection faces of five of the ten ejecting portions, whereas the wiper blade M5020C wipes vicinities of nozzles for ejection faces of the other five of the ten ejecting portions.

After wiping, the wiper portion M5020 abuts on a blade cleaner M5060. Thereby, the wiper blades M5020A to M5020C are configured to be cleaned of inks and the like which have been adhered to themselves. In addition, the wiper portion M5020 has the following configuration (a wetting liquid transferring unit). A wetting liquid is transferred onto the wiper blades M5020A to M5020C before wiping. This enhances cleaning performance of the wiping operation. Descriptions will be provided later for a configuration of this wetting liquid transferring unit and the wiping operation.

The suction pump M5000 is capable of generating negative pressure in a state where an airtight space is formed inside the cap M5010 by connecting the cap M5010 to the ejection faces. Thereby, inks can be filled in the ejecting portions from the ink tanks H1900. In addition, dust, adhering matter, bubbles and the like which exist in the ejection openings and the internal ink passage leading to the ejection openings can be removed by suction.

What is used for the suction pump M5000 is, for example, a tube pump. This includes a member having a curved surface which is formed by squeezing and holding at least part of a flexible tube; a roller being capable of pressing the flexible tube towards the member; and a roller supporting part which supports the roller, and which is capable of rotating. Specifically, the roller supporting part is rotated in a predetermined direction, and thereby the roller is rolled on the member in which the curved surface has been formed, while pressing the flexible tube. In response to this, the negative pressure is generated in the airtight space formed by the cap M5010. This negative pressure sucks inks from the ejection openings, and subsequently sucks up the inks into the tube or the suction pump from the cap M5010. Thereafter, the sucked inks are further transferred to a suitable member (a waste ink absorbing member) provided inside the lower case M7080.

Note that an absorbing member M5011 is provided to the inside portion of the cap M5010 for the purpose of reducing the amount of inks remaining on the ejection faces of the printing head H1001 after the suction. In addition, consideration is made for sucking inks, which remain in the cap M5010 and the absorbing member M5011, in a state where the cap M5010 is opened, and for thus precluding the ink residue from coagulating and for accordingly preventing an adverse affect from occurring subsequently by sucking. It is desirable that no abrupt negative pressure should work on the ejection faces by providing an open-to-atmosphere valve (not illustrated) in a middle of the ink suction passage, and by thus beforehand opening the valve when the cap M5010 is intended to be detached from the ejection faces.

Furthermore, the suction pump M5000 can be operated not only for the purpose of the recovery by suction, but also for the purpose of discharging inks which have been received by the cap M5010 by the preliminary ejection operation performed in the state where the cap M5010 is opposite to the ejection faces. Specifically, when an amount of inks held in the cap M5010 after preliminary ejection reaches a predetermined amount, the inks held in the cap M5010 can be transferred to the waste ink absorbing member through the tube by operating the suction pump M5000.

The series of operations performed successively, such as the operations of the wiper portion M5020, the ascent/descent of the cap M5010 and the opening/closing of the valve, can be controlled by means of a main cam (not illustrated) provided on the output axle of the motor E0003, and a plurality of cams and arms and like which move so as to follow the main cam. Specifically, rotation of the main cam in response to a direction in which the motor E0003 rotates operates cams, arms and the like in each of the units and parts. Thereby, the predetermined operations can be performed. The position of the main cam can be detected with a position detection sensor such as a photo-interrupter.

(H) Wetting Liquid Transferring Unit (Refer to FIGS. 16 and 17)

Recently, inks containing pigment components as color materials (pigmented inks) are increasingly used for the purpose of enhancing the printing density, water resistance, light resistance of printed materials. Pigmented inks are produced through dispersing color materials themselves, which are originally solids, into water by adding dispersants thereto, or by introducing functional groups to pigment surfaces. Consequently, dried matter of pigmented inks resulting from drying the inks through evaporating moisture from the inks on the ejection faces damages the ejection faces more than dried coagulated matter of dyed inks in which the color materials are dissolved at molecular level. In addition, polymer compounds used for dispersing the pigments into the solvent are apt to be adsorbed to the ejection faces. This type of problem occurs in matter other than pigmented inks in a case where polymer compounds exist in the inks as a result of adding reactive liquids to the inks for the purpose of administering the viscosities of the inks, for the purpose of enhancing the light resistance of the inks, or for other purposes.

In this embodiment, a liquid is transferred onto, and adhered to, the blades of the wiper portion M5020, and thus the wiping operation is performed with the wetted blades M5020, in order to solve the foregoing problem. Thereby, the present embodiment attempts at preventing the ejection faces from deteriorating due to the pigmented inks, at reducing the abrasion of the wiper, and at removing the accumulated matter by dissolving the ink residue accumulated on the ejection faces. Such a liquid is termed as the wetting liquid from the viewpoint of its function in the description. The wiping by use of this liquid is termed as the wet wiping.

This embedment adopts a configuration in which the wetting liquid is stored inside the main body of the printing apparatus. Reference numeral M5090 denotes a wetting liquid tank. As the wetting liquid, a glycerin solution or the like is contained in the wetting liquid tank M5090. Reference numeral M5100 denotes a wetting liquid holding member, which is fibrous member or the like. The wetting liquid holding member M5100 has an adequate surface tension for the purpose of preventing the wetting liquid from leaking from the wetting liquid tank M5090. The wetting liquid holding member M5100 is impregnated with, and holds, the wetting liquid. Reference numeral M5080 denotes a wetting liquid transferring member, which is made, for example, of a porous material having an adequate capillary force. The wetting liquid transferring member M5080 includes a wetting liquid transferring part M5081 which is in contact with the wiper blade. The wetting liquid transferring member M5080 is also in contact with the wetting liquid holding member M5100 infiltrated with the wetting liquid. As a result, the wetting liquid transferring member M5080 is also infiltrated with the wetting liquid. The wetting liquid transferring member M5080 is made of the material having the capillary force which enables the wetting liquid to be supplied to the wetting liquid transferring part M5081 even if a smaller amount of wetting liquid remains Descriptions will be provided for operations of the wetting liquid transferring unit and the wiper portion.

First of all, the cap M5010 is set at the descending position, and thus is escaped to a position where the carriage M4000 does not contact the blades M5020A to M5020C, In this state, the wiper portion M5020 is moved in the −Y direction, and is caused to pass through the part of the blade cleaner M5060. Accordingly, the wiper portion M5020 is caused to abut on the wetting liquid transferring part M5081 (refer to FIG. 17). By keeping the wiper portion M5020 in contact with the wetting liquid transferring part M5081 for an adequate length of time, an adequate amount of wetting liquid is transferred onto the wiper portion M5020.

Subsequently, the wiper portion M5020 is moved in the +Y direction. The blade contacts the blade cleaner M5060 only in a part of the surface of the blade cleaner M5060, and no wetting liquid is adhered to the part. For this reason, the wetting liquid remains to be held on the blade.

The blade is returned to the position where the wiping operation has been started. Thereafter, the carriage M4000 is moved to the position where the wiping operation is designed to be performed. Subsequently, the wiper portion M5020 is moved in the −Y direction. Thereby, the ejection faces of the printing head H1001 can be wiped with the surface to which the wetting liquid is adhered.

1.3 Configuration of Electrical Circuit

Descriptions will be provided next for a configuration of an electrical circuit of this embodiment.

FIG. 18 is a block diagram for schematically describing the entire configuration of the electrical circuit in the printing apparatus J0013. The printing apparatus to which this embodiment is applied is configured chiefly of the carriage board E0013, the main substrate E0014, a power supply unit E0015, a front panel E0106 and the like.

The power supply unit E0015 is connected to the main substrate E0014, and thus supplies various types of drive power.

The carriage board E0013 is a printed circuit board unit mounted on the carriage M4000. The carriage board E0013 functions as an interface for transmitting signals to, and receiving signals from, the printing head H1001 and for supplying head driving power through the head connector E0101. The carriage board E0013 includes a head driving voltage modulation circuit E3001 with a plurality of channels to the respective ejecting portions of the printing head H1001. The plurality of ejecting portions corresponding respectively to the plurality of mutually different colors. In addition, the head driving voltage modulation circuit E3001 generates head driving power supply voltages in accordance with conditions specified by the main substrate E0014 through the flexible flat cable (CRFFC) E0012. In addition, change in a positional relationship between the encoder scale E0005 and the encoder sensor E0004 is detected on the basis of a pulse signal outputted from the encoder sensor E0004 in conjunction with the movement of the carriage M4000. Moreover, the outputted signal is supplied to the main substrate E0014 through the flexible flat cable (CRFFC) E0012.

Figure 20:
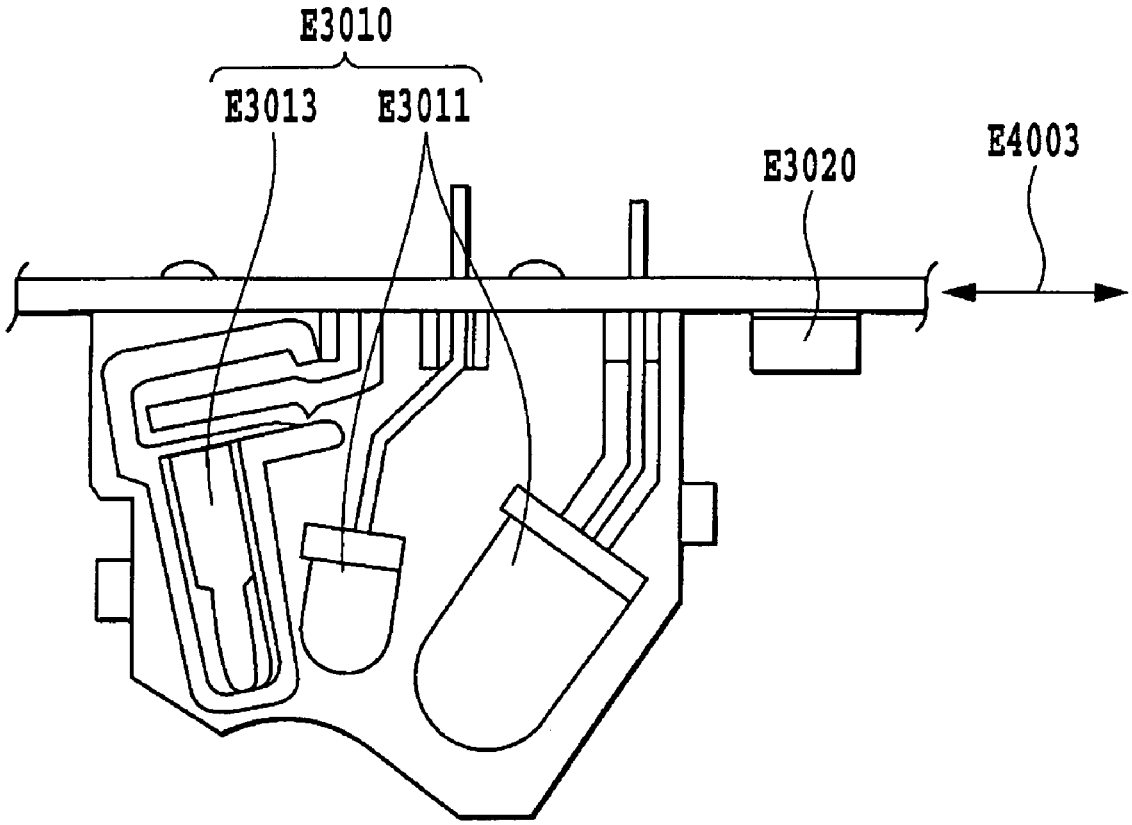
FIG. 20 is a diagram showing an example of a configuration of a multisensor system mounted on a carriage board shown in FIG. 18.

An optical sensor E3010 and a thermistor E3020 are connected to the carriage board E0013, as shown in FIG. 20. The optical sensor E3010 is configured of two light emitting devices (LEDs) E3011 and a light receiving element E3013. The thermistor E3020 is that with which an ambient temperature is detected. Hereinafter, these sensors are referred to as a multisensor system E3000. Information obtained by the multisensor system E3000 is outputted to the main substrate E00014 through the flexible flat cable (CRFFC) E0012.

The main substrate E0014 is a printed circuit board unit which drives and controls each of the sections of the ink jet printing apparatus of this embodiment. The main substrate E0014 includes a host interface (host I/F) E0017 thereon. The main substrate E0014 controls print operations on the basis of data received from the host apparatus J0012 (FIG. 1). The main substrate E0014 is connected to and controls various types of motors including the carriage motor E0001, the LF motor E0002, the AP motor E3005 and the PR motor E3006. The carriage motor E0001 is a motor serving as a driving power supply for causing the carriage M4000 to perform main scan. The LF motor E0002 is a motor serving as a driving power supply for conveying printing medium. The AP motor E3005 is a motor serving as a driving power supply for causing the printing head H1001 to perform recovery operations. The PR motor E3006 is a motor serving as a driving power supply for performing a flat-pass print operation; and the main substrate E0014 thus controls drive of each of the functions. Moreover, the main substrate E0014 is connected to sensor signals E0104 which are used for transmitting control signals to, and receiving detection signals from, the various sensors such as a PF sensor, a CR lift sensor, an LF encoder sensor, and a PG sensor for detecting operating conditions of each of the sections in the printer. The main substrate E0014 is connected to the CRFFC E0012 and the power supply unit E0015. Furthermore, the main substrate E0014 includes an interface for transmitting information to, and receiving information from a front panel E0106 through panel signals E0107.

The front panel E0106 is a unit provided to the front of the main body of the printing apparatus for the sake of convenience of user's operations. The front panel E0106 includes the resume key E0019, the LED guides M7060, the power supply key E0018, and the flat-pass key E3004 (refer to FIG. 6). The front panel E0106 further includes a device I/F E0100 which is used for connecting peripheral devices, such as a digital camera, to the printing apparatus.

Figure 19:
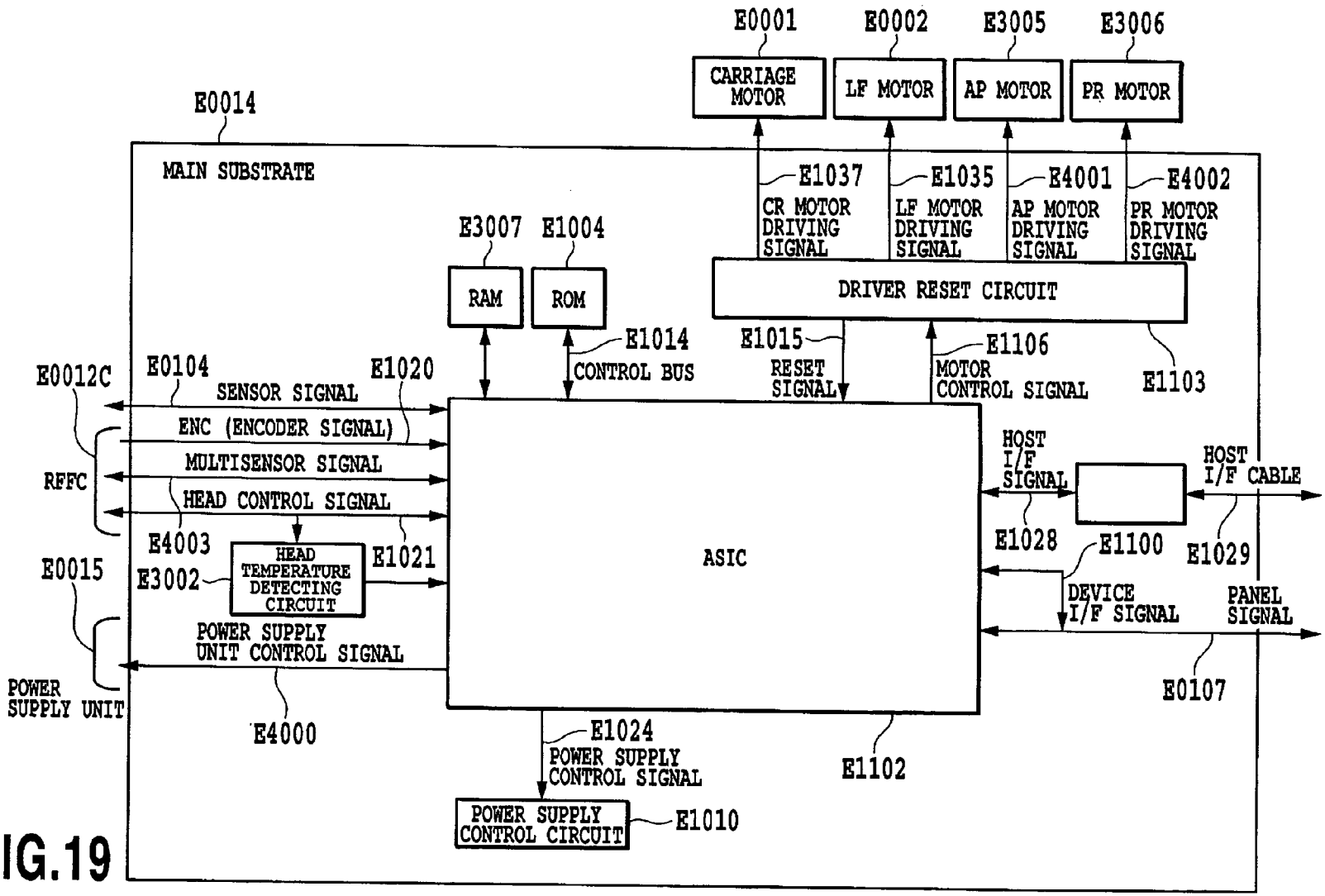
FIG. 19 is a block diagram showing an example of an internal configuration of a main substrate shown in FIG. 18.

FIG. 19 is a block diagram showing an internal configuration of the main substrate E1004.

In FIG. 19, reference numeral E1102 denotes an ASIC (Application Specific Integrated Circuit). The ASIC E1102 is connected to a ROM E1004 through a control bus E1014, and thus performs various controls in accordance with programs stored in the ROM E1004. For example, the ASIC E1102 transmits sensor signals E0104 concerning the various sensors and multisensor signals E4003 concerning the multisensor system E3000. In addition, the ASIC E1102 receives sensor signals E0104 concerning the various sensors and multisensor signals E4003 concerning the multisensor system. Furthermore, the ASIC E1102 detects encoder signals E1020 as well as conditions of outputs from the power supply key E0018, the resume key E0019 and the flat-pass key E3004 on the front panel E0106. In addition, the ASIC E1102 performs various logical operations, and makes decisions on the basis of conditions, depending on conditions in which the host I/F E0017 and the device I/F E0100 on the front panel are connected to the ASIC E1102, and on conditions in which data are inputted. Thus, the ASIC E1102 controls the various components, and accordingly drives and controls the ink jet printing apparatus.

Reference E1103 denotes a driver reset circuit. In accordance with motor controlling signals E1106 from the ASIC E1102, the driver reset circuit E1103 generates CR motor driving signals E1037, LF motor driving signals E1035, AP motor driving signals E4001 and PR motor driving signals 4002, and thus drives the motors. In addition, the driver reset circuit E1103 includes a power supply circuit, and thus supplies necessary power to each of the main substrate E0014, the carriage board E0013, the front panel E0106 and the like. Moreover, once the driver reset circuit E1103 detects drop of the power supply voltage, the driver reset circuit E1103 generates reset signals E1015, and thus performs initialization.

Reference numeral E1010 denotes a power supply control circuit. In accordance with power supply controlling signals E1024 outputted from the ASIC E1102, the power supply control circuit E1010 controls the supply of power to each of the sensors which include light emitting devices. The host I/F E0017 transmits host I/F signals E1028, which are outputted from the ASIC E1102, to a host I/F cable E1029 connected to the outside. In addition, the host I/F E0017 transmits signals, which come in through this cable E1029, to the ASIC E1102.

Meanwhile, the power supply unit E0015 supplies power. The supplied power is supplied to each of the components inside and outside the main substrate E0014 after voltage conversion depending on the necessity. Furthermore, power supply unit controlling signals E4000 outputted from the ASIC E1102 are connected to the power supply unit E0015, and thus a lower power consumption mode or the like of the main body of the printing apparatus is controlled.

The ASIC E1102 is a single-chip semiconductor integrated circuit incorporating an arithmetic processing unit. The ASIC E1102 outputs the motor controlling signals E1106, the power supply controlling signals E1024, the power supply unit controlling signals E4000 and the like. In addition, the ASIC E1102 transmits signals to, and receives signals from, the host I/F E0017. Furthermore, the ASIC E1102 transmits signals to, and receives signals from, the device I/F E0100 on the front panel by use of the panel signals E0107. As well, the ASIC E1102 detects conditions by means of the sensors such as the PE sensor and an ASF sensor with the sensor signals E0104. Moreover, the ASIC E1102 controls the multisensor system E3000 with the multisensor signals E4003, and thus detects conditions. In addition, the ASIC E1102 detects conditions of the panels signals E0107, and thus controls the drive of the panel signals E0107. Accordingly, the ASIC E1102 turns on/off the LEDs E0020 on the front panel.

The ASIC E1102 detects conditions of the encoder signals (ENC) E1020, and thus generates timing signals. The ASIC E1102 interfaces with the printing head H1001 with head controlling signals E1021, and thus controls print operations. In this respect, the encoder signals (ENC) E1020 are signals which are receives from the CRFFC E0012, and which have been outputted from the encoder sensor E0004. In addition, the head controlling signals E1021 are connected to the carriage board E0013 through the flexible flat cable E0012. Subsequently, the head controlling signals E1021 are supplied to the printing head H1001 through the head driving voltage modulation circuit E3001 and the head connector E0101. Various types of information from the printing head H1001 are transmitted to the ASIC E1102. Signals representing information on head temperature of each of the ejecting portions among the types of information are amplified by a head temperature detecting circuit E 3002 on the main substrate, and thereafter the signals are inputted into the ASIC E1102. Thus, the signals are used for various decisions on controls.

In the figure, reference numeral E3007 denotes a DRAM. The DRAM E3007 is used as a data buffer for a print, a buffer for data received from the host computer, and the like. In addition, the DRAM is used as work areas needed for various control operations.

1.4 Configuration of Printing Head

Descriptions will be provided below for a configuration of the head cartridge H1000 to which this embodiment is applied.

The head cartridge H1000 in this embodiment includes the printing head H1001, means for mounting the ink tanks H1900 on the printing head H1001, and means for supplying inks from the respective ink tanks H1900 to the printing head H1001. The head cartridge H1000 is detachably mounted on the carriage M4000.

Figure 21:
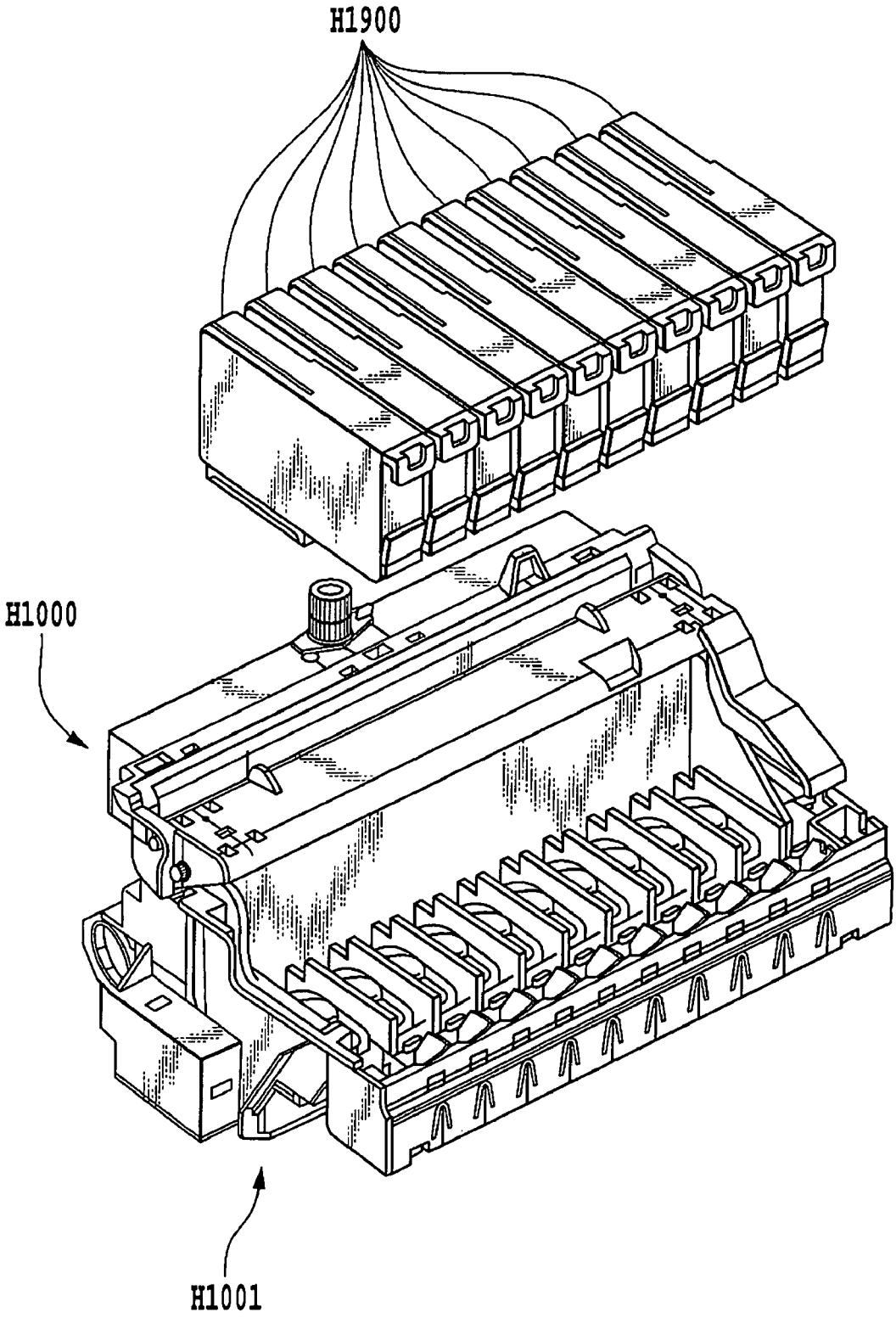
FIG. 21 is a perspective view of a head cartridge and ink tanks applied in the embodiment, which shows how the ink tanks are attached to the head cartridge.

FIG. 21 is a diagram showing how the ink tanks H1900 are attached to the head cartridge H1000 to which this embodiment is applied. The printing apparatus of this embodiment forms an image by use of the pigmented inks corresponding respectively to the ten colors. The ten colors are cyan (C), light cyan (Lc), magenta (M), light magenta (Lm), yellow (Y), black 1 (K1), black 2 (K2), red (R), green (G) and gray (Gray). For this reason, the ink tanks H1900 are prepared respectively for the ten colors. As shown in FIG. 21, each of the ink tanks can be attached to, and detached from, the head cartridge H1000. Incidentally, the ink tanks H1900 are designed to be attached to, and detached from, the head cartridge H1000 in a state where the head cartridge H1000 is mounted on the carriage M4000.

1.5 Configuration of Inks

Descriptions will be provided below for the ten color inks used in the present invention.

The ten colors used in the present invention are cyan (C), light cyan (Lc), magenta (M), light magenta (Lm), yellow (Y), black 1 (K1), black 2 (K2), gray (Gray), red (R) and green (G). It is desirable that all of the color materials used respectively for the ten colors should be pigments. In this respect, for the purpose of dispersing the pigments, publicly known dispersants may be used. Otherwise, for the purpose, it is sufficient that pigments surfaces are modified by use of a publicly known method, and that self-dispersants are added thereto. In addition, color materials used for at least some of the colors may be dyes as long as the use agrees with the spirit and scope of the present invention. Furthermore, color materials used for at least some of the colors may be what are obtained by harmonizing pigments and dyes in color, and a plurality of kinds of pigments may be included therein. Moreover, as for the ten colors of the present invention at least one kind of substance selected from the group consisting of an aqueous organic solvent, an additive, a surfactant, a binder and an antiseptic may be included in therein as long as the inclusion is within the spirit and the scope of the present invention.

Next, preferred constitutional materials for 10 color inks used in this embodiment will be described specifically.

(Pigment)

As color pigments, organic pigments may be used. More specifically, they may include dye lake-based pigments, such as acid dye lake and basic dye lake; insoluble azo pigments, condensed azo pigments and azo lake pigments, such as mono azo yellow, disazo yellow, β-naphthal, naphthal AS, pyrazolone and benzimidazolone; and multiple condensed ring pigments, such as phthalocyanine, quinacridone, anthraquinone, perylene, indigo, dioxazines, quinophthalone, isoindolinone and diketopyroropyrole. Color pigments are not limited to these and other organic pigments may be used.

As a black pigment, carbon black is preferably used. For example, furnace black, lamp black, acetylene black and channel black may be used. Further, carbon black that is newly prepared for this invention may be used. This invention, however, is not limited to these pigments and can use the conventionally known carbon black. Rather than using carbon black, it is possible to use, as black pigments, magnetic fine particles such as magnetite and ferrite, or titanium black.

For dispersion of pigments, commonly known dispersants may be used, or pigment surfaces may be modified by generally known methods to provide a self dispersion capability.

To the ink may be added water-soluble organic solvents, additives, surfactants and antiseptics. For these, commonly available materials may be used.

2. Characteristic Construction

Now, details of characteristic construction of this invention will be described.

First Embodiment

Figure 22:
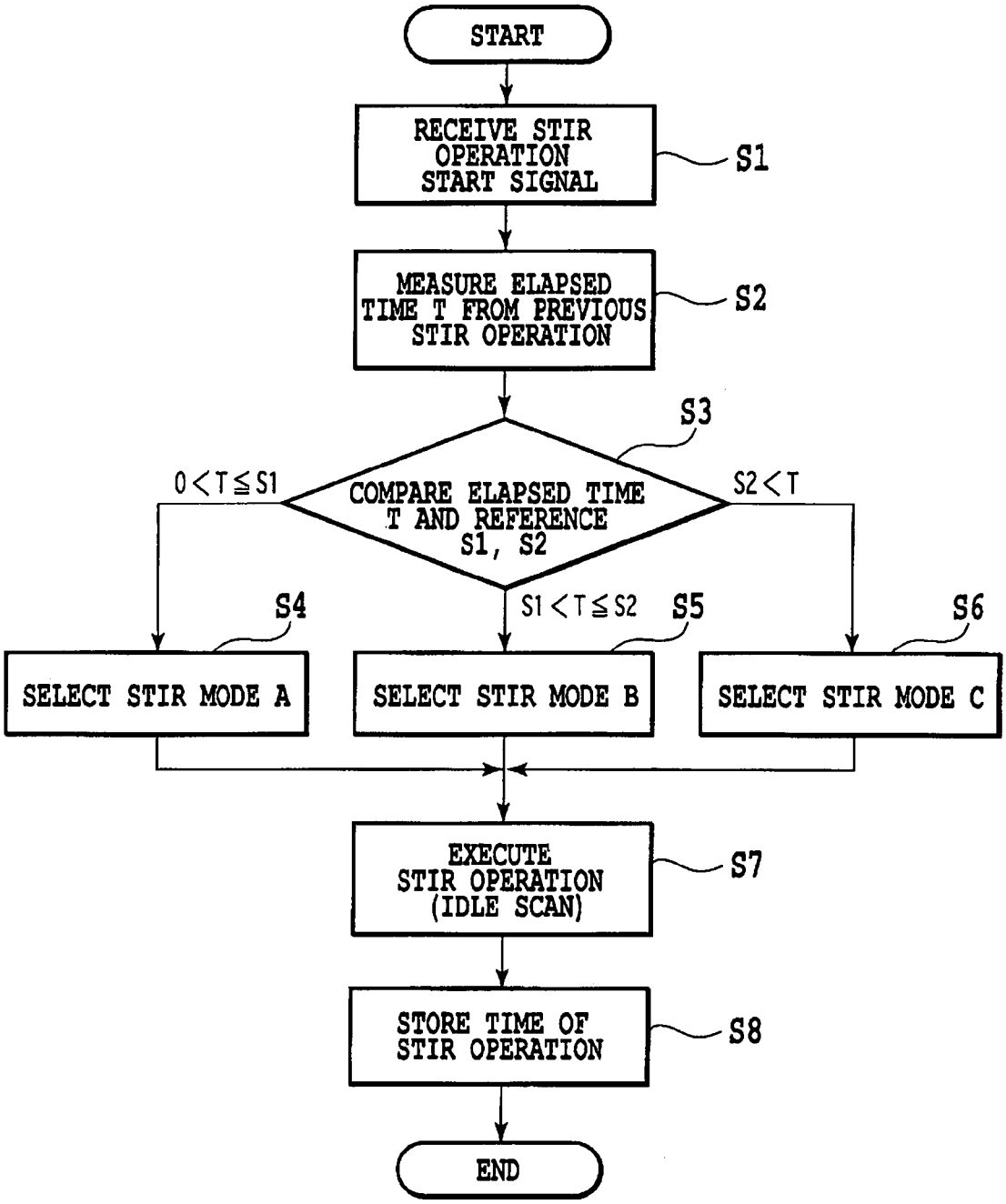
FIG. 22 is a flow chart showing a print sequence in a first embodiment of this invention.

FIG. 22 is a flow chart showing an ink stirring sequence in the first embodiment of this invention.

The ink stirring operation in the ink tank is performed at various points in time, such as before the start of print operation or before the start of a suction-based recovery operation. That is, when a start signal, which is issued when it is determined necessary to stir ink, is received, a carriage M4000 mounting a print head and an ink tank is reciprocally moved in the main scan direction to agitate the ink in the ink tank by an acceleration of the carriage. The reciprocal movement of the carriage M4000 to stir ink is different from a reciprocal movement of the carriage M4000 performed during the printing of an image. In the following, the operation to reciprocally move the carriage M4000 for ink agitation is called a "stir operation" or "idle scan".

In the stir sequence of FIG. 22, a start signal for executing the stir operation is first received (step S1). Then, an elapsed time T from the previous stir operation is measured (step S2). That is, a difference between the point in time T(n−1) when the previous stir operation was performed and the point in time T(n) when a stir operation is about to be executed, {T(n−1)−T(n)}, is measured as the elapsed time T.

Next, the elapsed time and decision reference times S1, S2 are compared (step S3). Times S1, S2 are in a relation of S1<S2. Then, depending on the result of this comparison, one of stir modes A, B, C described later is chosen (step S4, S5, S6). That is, if 0<T≦S1, a stir mode A is selected (Step 4); if S1<T≦S2, a stir mode B is selected (step S5); and if S2<T, a stir mode C is selected (step S6).

After this, according to the selected stir mode, the stir operation is executed (step S7). Then, after the stir operation is completed, the finish time is stored in an EEPROM not shown as the time T(n−1) (step S8). The EEPROM may be installed on the ink tank side or the printing apparatus side. When the EEPROM is installed in the ink tank, it is possible to select an optimal stir mode by considering the stir time for each of the ink tanks that can be mounted in the printing apparatus.

In this example, the reference time S1 is set to 120 hours and the reference time S2 to 240 hours. The stir modes A, B, C, as shown in FIG. 26, have different numbers of carriage operations (idle scans) during the stir operation. That is, the stir modes A, B, C have 20, 60 and 120 reciprocal movements, respectively, as the number of idle scans. Therefore, if the elapsed time T after the previous stir operation is not greater than 120 hours, the carriage is reciprocated 20 times to execute the stir operation. If the elapsed time T is more than 120 hours and up to 240 hours, the carriage is reciprocated 60 times for stir operation. If the elapsed time exceeds 240 hours, the stir operation is done by reciprocating the carriage 120 times.

As described above, when the elapsed time T is short, i.e., the degree of sedimentation of pigment component in the ink is small, the number of carriage reciprocating movements for ink stirring is set small. When the elapsed time T is long, i.e., the rate of sedimentation of the pigment component in the ink is large, the number of carriage reciprocating movements is set large. Changing the number of stir motions as described above allows the ink to be stirred sufficiently according to the settling degree of pigment components, thereby making the ink concentration uniform in the ink tank. When the number of stir motions is small, the time it takes to complete the stir operation is naturally small. For example, if a stir operation is performed prior to the print operation, the number of stir motions is set to the minimum required in order to reduce the waiting time for the start of the print operation.

The number of stir modes is not limited to three, two stir modes or more than or equal to four stir modes may be performed. Further, the time T(n−1) is not limited to the end time of the stir operation and may represent any specific point in time before or during the stir operation. The only requirement is that the time is related to the stir operation.

When, after an ink tank is replaced, the first stir operation is to be performed, there is no previous stir operation time T(n−1) stored. In that case, the settling degree of the pigment components in the ink is not known and it is therefore preferred to select a stir mode with the largest number of stir motions.

As described above, in the present embodiment, by selecting a stir mode according to the elapsed time from the previous stir operation, it is possible to execute the ink stirring operation at a required time and to a required degree. Therefore, the ink in the ink tank can be made uniform in concentration and thereby print images without any impairment.

Second Embodiment

In an ink tank accommodating ink that needs to be agitated, a conventional stir means is preferably installed to enhance the stir efficiency. More specifically, a steel ball may be put in the ink tank so that it moves at a bottom of the ink tank during the stir operation. Alternatively, a stir plate may be suspended in the ink tank so that it oscillates by acceleration during idle scans.

If such a stir means is provided, as the volume of ink remaining in the ink tank changes, an ink stirring action of the stir means changes. For example, when a stir plate is suspended in the ink tank, as the volume of ink remaining in the ink tank decreases, the range of movement of the stir plate in the ink, i.e., the ink stirring range, narrows. Therefore, the stirring effectiveness may be reduced. With this problem taken into account, this embodiment changes the stir operation according to the remaining volume of ink.

Figure 23:
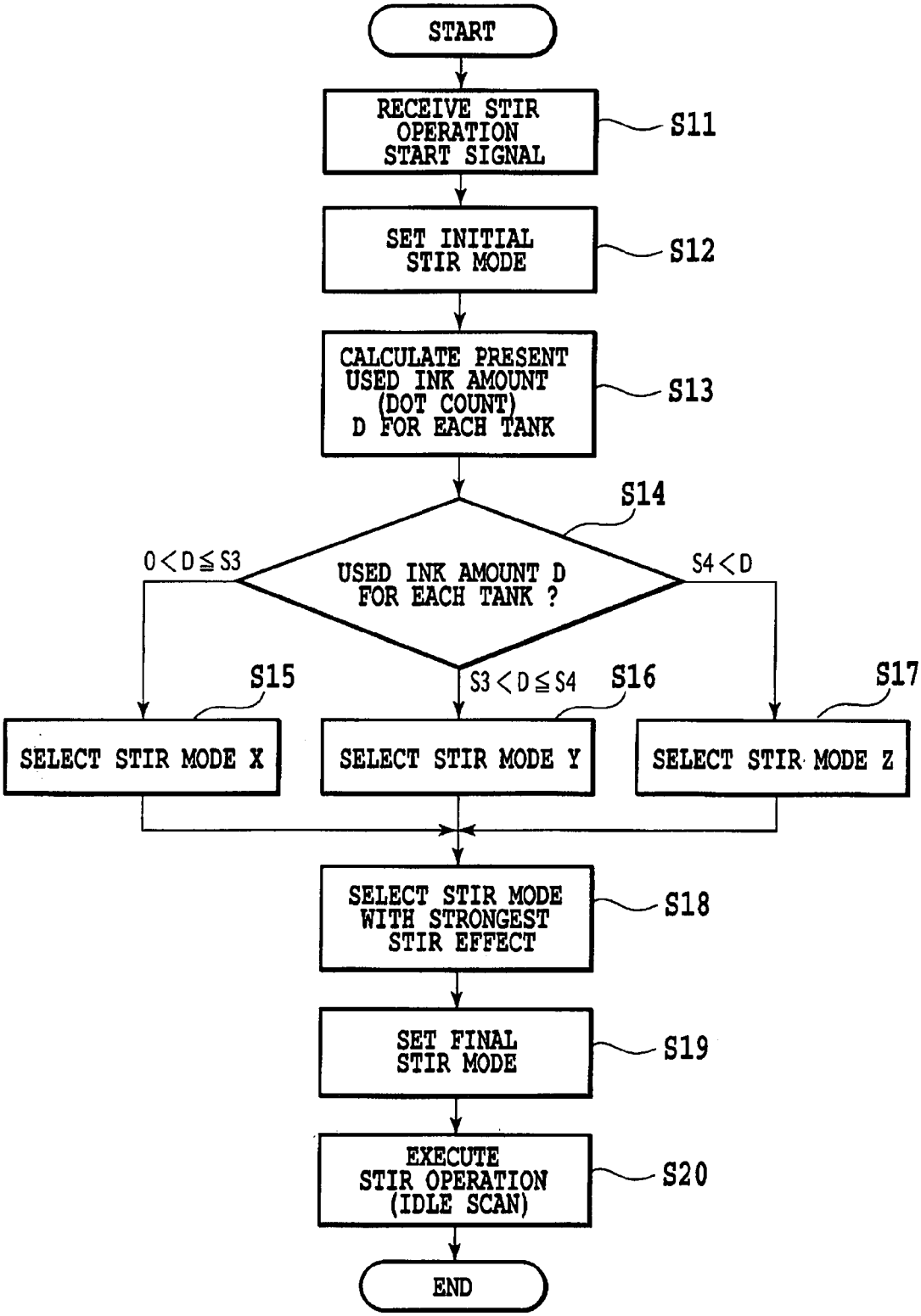
FIG. 23 is a flow chart showing a print sequence in a second embodiment of this invention.

FIG. 23 is a flow chart showing a stir sequence in the second embodiment of this invention.

In this embodiment, too, the stir operation is executed at various points in time, for example before the start of print operation or before the start of a suction-based recovery operation, as in the first embodiment. First, after receiving a stir operation start signal (step S11), an initial stir mode is set (step S12). This will be detailed later. Next, for each of the ink tanks mounted in the carriage (in this example, 10 ink tanks accommodating 10 color pigment inks), an amount D of ink used to date is measured (step S13).

The used ink amount D can be determined by multiplying a count value (dot count) of ink dots formed with an ink ejection amount required to form a single ink dot. In that case, the dot count can be counted based on the print data. Measuring the used ink amount D can be done in any desired way. For example, it may be determined by directly measuring the amount of ink ejected and discharged from the print head or by measuring or presuming the amount of ink remaining in the ink tank. The only requirement is that the remaining ink amount can be determined for each ink tank.

Next, the used ink amount D of ink for each ink tank is compared with reference used amounts S3, S4. The reference used amounts are in a relation of S3<S4. According to the result of comparison, a selection is made of one of stir modes X, Y, Z described later (step S15, S16, S17). That is, if 0<D≦S3, a stir mode X is selected (step S15); if S3<D≦S4, a stir mode Y is selected (step S16); and if S4<D, a stir mode Z is selected (step Ss17).

Then, from among the stir modes selected for the individual ink tanks, a mode with the highest stirring degree is chosen (step S18). Based on the selected mode and the initial stir mode set at step S12, a final stir mode is set (step S19), as detailed later. Next, according to the final stir mode thus set, the stir operation is executed (step S20).

In this example, the reference used amount S3 is set at 7 g and the reference used amount S4 at 10 g. The stir modes X, Y, Z, as shown in FIG. 27 have different numbers of carriage movements (idle scans) during the stir operation. That is, the numbers of idle scans in the stir modes X, Y, Z are set at 0, 30 and 60 reciprocal movements, respectively. Therefore, for an ink tank with the used ink amount of 7 g or less, the stir mode X in which the carriage is not reciprocated (0 reciprocal movements) is selected. For an ink tank with the used ink amount of greater than 7 g and up to 10 g, the stir mode Y is chosen which reciprocates the carriage 30 times. For an ink tank with the used ink amount in excess of 10 g, the stir mode Z is chosen which reciprocates the carriage 60 times. As the used ink amount of ink increases, i.e., the remaining ink amount in the tank decreases, the number of carriage movements increases to enhance the level of ink stirring action.

In this example, ten ink tanks accommodating 10 color pigment inks are mounted on the carriage, and an appropriate stir mode is selected for each ink tank. Since the inks in the individual ink tanks are used according to an image being printed, their used ink amounts naturally differ. In step S18, from among the stir modes selected for each ink tank, a mode with the highest stirring level is chosen.

As the initial stir mode, a mode that reciprocates the carriage a predetermined number of times is set. In this example, the initial stir mode set reciprocates the carriage (for idle scan) 50 times. When the used ink amount D is 0 g<D≦7 g for all ink tanks, a stir mode with 50 (=50+0) idle scans is set as the final stir mode. If the used ink amount D falls in the range of 7 g<D≦10 g for one or more of the ink tanks, a stir mode with 80 (=50+30) idle scans is set as the final stir mode. And if the used ink amount D exceeds 10 g (10 g<D) for one or more of the ink tanks, a stir mode with 110 (=50+60) idle scans is set as the final stir mode. In the stir operation (step S20), the carriage is reciprocated the same number of times as the idle scan number of the final stir mode set as described above.

In this example, as the used ink amount increases, i.e., the remaining ink amount in the ink tank decreases, the ink stirring level is increased. This keeps the ink concentration uniform whatever the remaining ink amount may be. Further, if a stir means is provided, such as a steel ball placed in the ink tank so that it can move at the bottom of the ink tank, the ink stirring level can be reduced as the remaining ink amount decreases. In that case, a setting may be made to reduce the ink stirring level as the used ink amount increases.

As described above, in this embodiment, by selecting a stir mode according to the used ink amount to execute the ink stirring operation at a required time and to a required degree. Therefore, it is possible to keep the ink concentration in the ink tank uniform at all times and thereby print images without any impairment. The number of stir modes is not limited to three and setting more stir modes allows the number of stir motions to be changed in finer steps.

Third Embodiment

Figure 24A:
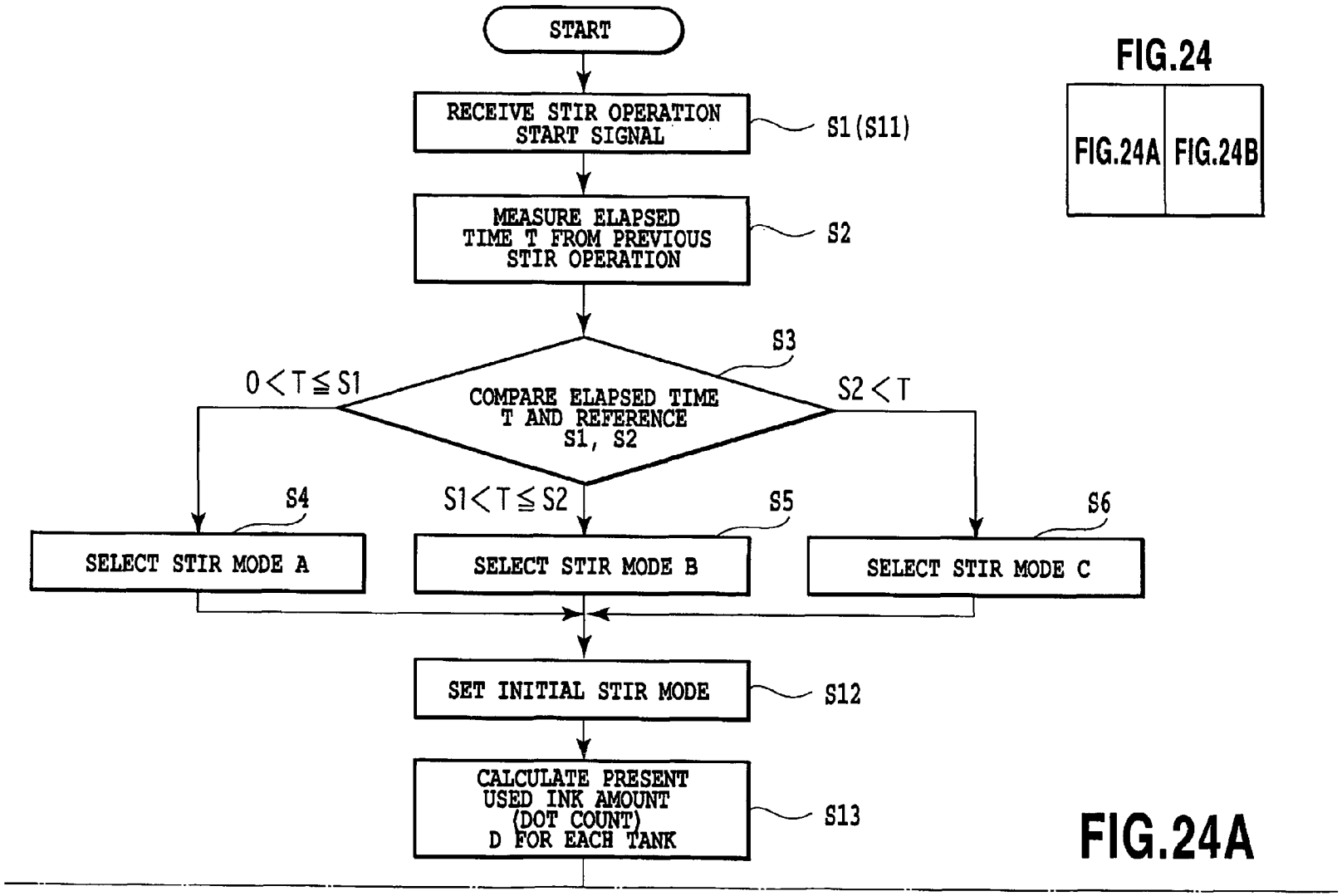
FIG. 24A is a flow chart showing a print sequence in a third embodiment of this invention.
Figure 24B:
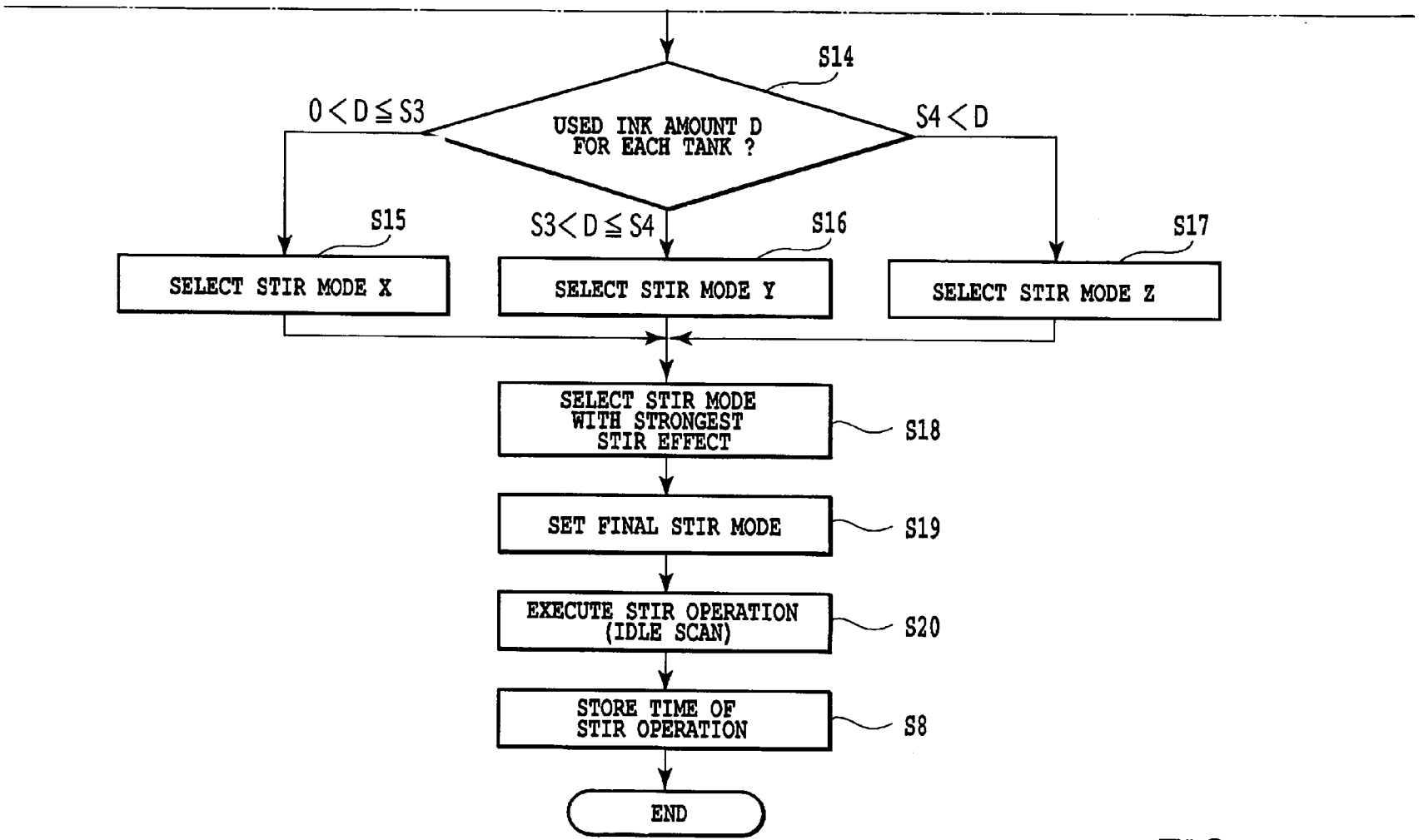
FIG. 24B is a flow chart showing a print sequence in a third embodiment of this invention.

FIG. 24 is a flow chart showing a stirring sequence in a third embodiment of this invention. This embodiment is a combination of the first and second embodiments. So, steps similar to those of the preceding embodiments are given like step numbers and their detailed explanations will be omitted.

In this embodiment, one of stir modes A, B, C is first selected based on an elapsed time T from the previous stir operation (step S1 to S6), as in the first embodiment. Then, the selected stir mode is set as an initial stir mode (step S12). As in the second embodiment, a final stir mode is set based on the initial stir mode and a used ink amount D for each of the 10 ink tanks mounted on the carriage (step S13 to S19). Then, a stir operation is executed according to the final stir mode (step S20). After this, a finish time of the stir operation is stored as time T(n−1) in an EEPROM, as in the first embodiment (step S8).

When, after an ink tank is replaced, the first stir operation is to be performed, there is no previous stir operation time T(n−1) stored. In that case, the settling degree of the pigment components in the ink is not known and it is therefore preferred to select a stir mode with the strongest stirring action, as in the first embodiment. The selected stir mode with the strongest stirring action is set as an initial stir mode in step S12.

As described above, in this embodiment, by setting a stir mode according to the elapsed time from the previous stir operation and the used ink amount, it is possible to execute the ink stirring operation at a required time and to a required degree. Therefore, printing an image can be performed without any impairment.

Fourth Embodiment

Figure 25:
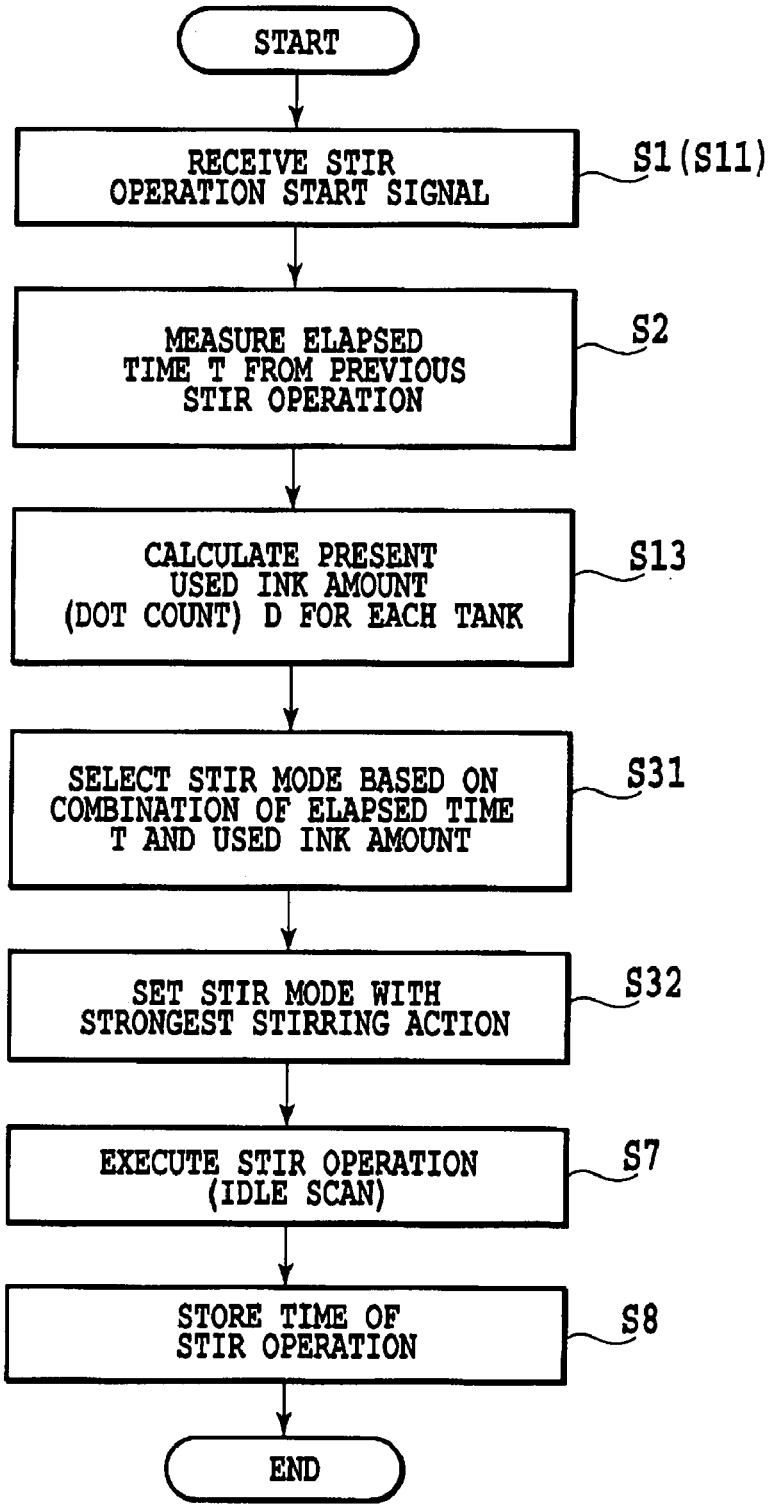
FIG. 25 is a flow chart showing a print sequence in a fourth embodiment of this invention.

FIG. 25 is a flow chart showing a stirring sequence in a fourth embodiment of this invention. In this embodiment, steps similar to those of the first and second embodiments are given like step numbers and their detailed explanations will be omitted.

First, after a start signal for the stir operation is received in step S1, an elapsed time T from the previous stir operation is measured (step S2), as in the first embodiment. Next, as in the second embodiment, a used ink amount D for each of the plurality of ink tanks mounted on the carriage is measured (step S13). Then, a stir mode is selected based on a combination of the elapsed time T and the used ink amount D for each ink tank (step S31). FIG. 28 shows an example relation between the elapsed time T, the used ink amount D and the stir mode. Based on this relation, a stir mode is chosen that matches the combination of the elapsed time T and the used ink amount D. If, for example, the elapsed time T is 120 hours or more and less than 250 hours and the used ink amount D is in a range of between more than 7 g and 10 g or less, the stir mode B is selected.

After the stir modes are selected for the individual ink tanks, a stir mode with the strongest stirring action is picked up and set (step S32). Then, according to the set stir mode, the stir operation is executed (step S7). Then, as in the first embodiment, the end time of the stir operation is stored as time T(n−1) in an EEPROM (step S8).

When, after an ink tank is replaced, the first stir operation is to be performed, there is no previous stir operation time T(n−1) stored. In that case, the settling degree of the pigment components in the ink is not known and it is therefore preferred in step S12 to select a stir mode with the strongest stirring action.

By preparing a matrix, such as shown in FIG. 28, that associates the elapsed time from the previous stir operation and the used ink amount, a setting of the stir mode is facilitated. In this embodiment, too, the ink stirring operation can be performed at a required time and to a required degree and thereby print images without any impairment, as in the preceding embodiments.

Further, by providing an EEPROM for each ink tank, a stir mode based on a combination of the elapsed time T and the used ink amount D can be selected for each ink tank.

Other Embodiments

As for the stir mode, it is possible to use not only the modes that differ in the number of stir motions (idle scans) but also those that differ in at least one of parameters, such as a carriage reciprocating speed, an acceleration and a distance moved for the stirring of ink. What is required is that the stir modes allow an optimal stir operation to be executed according to the state of ink in the ink tank.

In the ink tank, an ink stirring means is preferably installed to agitate the ink in the ink tank as the carriage is moved during the stir operation. The ink stirring means may use a variety of stirring members that can be moved or oscillated in the ink tank. It is, however, not a necessary condition to provide the stirring means in the ink tank.

Further, at least a part of the control function for controlling the stir operation may be provided in a host device that sends a print signal to the printing apparatus.

The print head and the ink tank are not necessarily constructed separate and may be integrally formed as a head-tank one-piece structure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-168007, filed Jun. 16, 2006, which is hereby incorporated by reference herein in its entirety.

What is claimed is:

1. An ink jet printing apparatus for printing an image on a print medium by ejecting ink from an ink ejection port, the ink jet printing apparatus comprising:

a carriage mounting an ink tank containing ink to be supplied to the ink ejection port, the carriage being reciprocally moved while ink is ejected from the ink ejection port; and a controller configured to execute first and second stir movements for stirring ink in the ink tank during a non-print operation, the first and second stir movements being executed by movements of the carriage based on a determination of an amount of consumed ink from the ink tank, the amount of consumed ink when the second stir movement is executed being larger than the amount of consumed ink when the first stir movement is executed, the number of movements in the second stir movement being more than that in the first stir movement.

2. The ink jet printing apparatus according to claim 1, wherein the carriage can mount a plurality of the ink tanks, wherein the controller executes the first stir movement or the second stir movement corresponding to the ink tank from which the greatest amount of ink is consumed.

3. The ink jet printing apparatus according to claim 1, wherein regardless of an elapsed time from a previous stir operation, the number of the movements in the second stir movement is more than the number of movements in the first stir movement.

4. The ink jet printing apparatus according to claim 1, wherein in a case that an elapsed time from a previous stir operation is within a predetermined time, the number of the movements in the second stir movement is more than the number of movements in the first stir movement.

5. The ink jet printing apparatus according to claim 1, wherein the ink tank has a stirring member moved by the movements of the first and second stir movements.

6. The ink jet printing apparatus according to claim 1, wherein the ink in the ink tank is a pigment ink.

7. The ink jet printing apparatus according to claim 1, wherein the determination of the amount of consumed ink is based on a number of ink dots to be formed on the print medium.

8. The ink jet printing apparatus according to claim 1, wherein the controller executes third and fourth stir movements for stirring ink in the ink tank during a non-print operation, the third and fourth stir movements being executed by movements of the carriage based on a measurement of elapsed time from a previous stir operation, the elapsed time when the fourth stir movement is executed being longer than the elapsed time when the third stir movement is executed, the number of movements in the fourth stir movement being more than that in the third stir movement.

9. An ink jet printing apparatus for printing an image on a print medium by ejecting ink from an ink ejection port, the ink jet printing apparatus comprising:

a carriage mounting an ink tank containing ink to be supplied to the ink ejection port, the carriage being reciprocally moved while ink is ejected from the ink ejection port; and a controller configured to execute first and second stir movements for stirring ink in the ink tank during a non-print operation, the first stir movement being executed by movements of the carriage based on a determination that an amount of consumed ink is a first amount, the second stir movement being executed by movements of the carriage based on a determination that the amount of consumed ink is a second amount larger than the first amount, the number of movements in the second stir movement being more than that in the first stir movement.

10. An ink jet printing apparatus for printing an image on a print medium by ejecting ink from an ink ejection port, the ink jet printing apparatus comprising:

a carriage mounting an ink tank containing ink to be supplied to the ink ejection port, the carriage being reciprocally moved while ink is ejected from the ink ejection port; and a controller configured to execute first and second stir movements for stirring ink in the ink tank during a non-print operation, the first stir movement being executed by movements of the carriage based on a determination that an amount of consumed ink is equal to or less than a predetermined amount, the second stir movement being executed by movements of the carriage based on a determination that the amount of consumed ink is more than the predetermined amount, the number of movements in the second stir movement being more than that in the first stir movement.

* * * * *